US011378906B2

(12) United States Patent
Matsumura et al.

(10) Patent No.: US 11,378,906 B2
(45) Date of Patent: Jul. 5, 2022

(54) IMAGE FORMING APPARATUS THAT PROVIDES MANAGEMENT APPARATUS WITH DATA THAT CAN BE UTILIZED FOR DATA ANALYSIS, CONTROL METHOD FOR THE IMAGE FORMING APPARATUS, STORAGE MEDIUM, AND MANAGEMENT SYSTEM

(71) Applicant: CANON KABUSHIKI KAISHA, Tokyo (JP)

(72) Inventors: Takeshi Matsumura, Chiba (JP); Shinya Suzuki, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/375,059

(22) Filed: Jul. 14, 2021

(65) Prior Publication Data

US 2022/0035290 A1 Feb. 3, 2022

(30) Foreign Application Priority Data

Jul. 31, 2020 (JP) ..... JP2020-130873
Aug. 4, 2020 (JP) ..... JP2020-132484

(51) Int. Cl.
*G03G 15/00* (2006.01)

(52) U.S. Cl.
CPC ..... *G03G 15/5041* (2013.01); *G03G 15/5025* (2013.01); *G03G 15/5054* (2013.01); *G03G 15/5079* (2013.01)

(58) Field of Classification Search
CPC ..... G03G 15/5041; G03G 15/5025; G03G 15/5054; G03G 15/5079
See application file for complete search history.

(56) References Cited

U.S. PATENT DOCUMENTS

2009/0033993 A1* 2/2009 Nakazato ..... G06F 3/1286 358/1.15
2012/0075659 A1* 3/2012 Sawada ..... G03G 15/55 358/1.14

FOREIGN PATENT DOCUMENTS

JP 2004291530 A * 10/2004
JP 2011166427 A 8/2011
JP 2020003656 A 1/2020

* cited by examiner

*Primary Examiner* — Susan S Lee
(74) *Attorney, Agent, or Firm* — Rossi, Kimms & McDowell LLP

(57) ABSTRACT

An image forming apparatus capable of providing a management apparatus with data that can be utilized for data analysis other than detection of signs of abnormality while keeping down costs required to build and maintain a communication environment. The image forming apparatus has a sensor. In the image forming apparatus, second data for use in detecting a sign of abnormality is generated based on first data comprised of measured values obtained by the sensor. The second data is transmitted directly or indirectly to the management apparatus that detects the sign of abnormality. Wherein, the second data is data that indicates characteristics of the image forming apparatus and has a smaller data amount that that of the first data.

11 Claims, 22 Drawing Sheets

*FIG. 6A*

| 601 | 602 | 603 | 604 | 605 | 606 |
|---|---|---|---|---|---|
| DATA ITEM (DATA ID) | DATA SOURCE | DATA TYPE | FEATURE EXTRACTION PROCESS | DETERMINATION PROCESS | PREDICTION REQUEST ID |
| SCAN COUNTER (0-0001) | SCANNER UNIT | COUNT VALUE | – | – | – |
| PRINT COUNTER (1-0001) | PRINTER UNIT | COUNT VALUE | – | – | – |
| FIXING UNIT TEMPERATURE (1-0002) | PRINTER UNIT | SENSOR MEASURED VALUE | MAXIMUM VALUE CALCULATION PROCESS | THRESHOLD PROCESS | 1 |
| ⋮ | ⋮ | ⋮ | ⋮ | ⋮ | ⋮ |
| FIXING BELT MOTOR ROTATIONAL ACCELERATION (1-2002) | PRINTER UNIT | SENSOR MEASURED VALUE | FREQUENCY ANALYSIS | PERIOD ANALYSIS | 2 |
| INTERMEDIATE TRANSFER BELT SPEED (1-2003) | PRINTER UNIT | SENSOR MEASURED VALUE | MOVING-AVERAGE PROCESS | INCLINATION ANALYZING PROCESS | 2 |
| TRANSFER ROLLER RUNNING DISTANCE (1-2100) | PRINTER UNIT | SENSOR MEASURED VALUE | HISTOGRAM CREATING PROCESS | DISPERSION RATIO | 3 |
| ⋮ | ⋮ | ⋮ | ⋮ | ⋮ | ⋮ |
| LOG DATA (3-0001) | STORAGE DEVICE | TEXT | – | – | – |

*FIG. 6B*

607 608 609

| DATA ITEM (DATA ID) | 2020/01/01/00:00:00 | 2010/01/01/00:00:30 | 2010/01/01/00:01:35 |
|---|---|---|---|
| FIXING UNIT TEMPERATURE (1-0002) | x=t, y=80 | x=t, y=81 | – |
| ⋮ | ⋮ | ⋮ | ⋮ |
| FIXING BELT MOTOR ROTATIONAL ACCELERATION (1-2002) | x=t, y=20 | x=t, y=21 | – |
| TRANSFER ROLLER RUNNING DISTANCE (1-2100) | x=80, y=1 | x=160, y=1 | – |
| ⋮ | ⋮ | ⋮ | ⋮ |
| | | | |
| ⋮ | ⋮ | ⋮ | ⋮ |

IMAGE FORMING APPARATUS THAT PROVIDES MANAGEMENT APPARATUS WITH DATA THAT CAN BE UTILIZED FOR DATA ANALYSIS, CONTROL METHOD FOR THE IMAGE FORMING APPARATUS, STORAGE MEDIUM, AND MANAGEMENT SYSTEM

BACKGROUND OF THE INVENTION

Field of the Invention

The present invention relates to an image forming apparatus that provides a management apparatus with data that can be utilized for data analysis, a control method for the image forming apparatus, a storage medium, and a management system.

Description of the Related Art

A management system is known which monitors a status of an image forming apparatus and detects a sign of abnormality in the image forming apparatus based on information about the status of the image forming apparatus. In the management system, when a sign of abnormality in the image forming apparatus is detected, a maintenance person is requested to perform maintenance, and the maintenance person who has received the request performs maintenance of the image forming apparatus. By performing maintenance of the image forming apparatus when a sign of abnormality is detected, downtime caused by a failure of the image forming apparatus is avoided because appropriate actions can be taken before the image forming apparatus fails and becomes inoperative.

The management system is comprised of a management apparatus and a plurality of image forming apparatuses, and the management apparatus is connected to the plurality of image forming apparatuses via a network. For example, in the management system, the image forming apparatus transmits status information including a plurality of measured values obtained by various sensors provided in the image forming apparatuses to the management apparatus, which in turn accumulates the status information received from each of the image forming apparatuses (see, for example, Japanese Laid-Open Patent Publication (Kokai) No. 2011-166427). In this management system, the management apparatus calculates a feature value representing a status of one image forming apparatus based on status information received from the one image forming apparatus and detects a sign of abnormality in the one image forming apparatus based on a trend of the progression of the calculated feature value. In this management system, status information about the plurality of image forming apparatuses is collected in the management apparatus, and the status information includes a plurality of measured values obtained by the various sensors in the image forming apparatuses. For this reason, the status information can be utilized for data analysis other than prediction of a sign of abnormality. For example, the status information can be used to predict when maintenance of an image forming apparatus will be required (hereafter referred to merely as "the maintenance time") before a sign of abnormality in the image forming apparatus is detected. On the other hand, since the status information includes a plurality of measured values as described above, data traffic increases when the image forming apparatus transmits the status information to the management apparatus, and significant costs are required to build and maintain a communication environment that implements such data communication. On the other hand, in another management system, the image forming apparatus calculates a feature value representing a status of the image forming apparatus based on status information and transmits information about a sign of abnormality detected based on a trend of the progression of the calculated feature value to the management apparatus (see, for example, Japanese Laid-Open Patent Publication (Kokai) No. 2020-3656). The information about the sign of abnormality does not include a plurality of measured values obtained by the various sensors described above but includes only limited information such as information that identifies a component whose sign of abnormality has been detected, and hence the information about the sign of abnormality has a smaller data amount than that of the status information. Therefore, the arrangement in which the image forming apparatus transmits information about a sign of abnormality to the management apparatus can reduce costs required to construct and maintain the communication environment as compared to the arrangement in which the status information is transmitted.

However, in the arrangement in which the image forming apparatus transmits information about a sign of abnormality to the management apparatus, information accumulated in the management apparatus is only limited information such as information that identifies a component whose sign of abnormality has been detected. For this reason, the information accumulated in the management apparatus cannot be utilized for data analysis other than detection of signs of abnormality. Namely, according to the prior art, it is impossible to provide the management apparatus with data that can be utilized for data analysis other tan detection of signs of abnormality while keeping down costs required to build and maintain the communication environment. It is also impossible to utilize the accumulated information in estimating the maintenance time for the image forming apparatus. Namely, according to the prior art, it is impossible to predict the maintenance time for the image forming apparatus while keeping down costs required to build and maintain the communication environment.

SUMMARY OF THE INVENTION

The present invention provides an image forming apparatus that is capable of providing a management apparatus with data that can be utilized for data analysis other than detection of signs of abnormality while keeping down costs required to build and maintain a communication environment, a control method for the image forming apparatus, a storage medium, and a management system.

Accordingly, the present invention provides an image forming apparatus with a sensor, comprising at least one memory that stores a set of instructions, and at least one processor that executes the instructions, the instructions, when being executed, causing the image forming apparatus to generate, based on first data comprising measured values obtained by the sensor, second data for use in detecting a sign of abnormality in the image forming apparatus, and transmit the second data directly or indirectly to a management apparatus that detects the sign of abnormality, wherein the second data is data that indicates characteristics of the image forming apparatus and has a smaller data amount than that of the first data.

According to the present invention, the management apparatus is provided with data that can be utilized for data analysis other than detection of signs of abnormality while keeping down costs required to build and maintain a communication environment. Moreover, according to the present invention, when maintenance of the image forming apparatus should be performed is predicted while costs required to build and maintain a communication environment are kept down.

Further features of the present invention will become apparent from the following description of exemplary embodiments (with reference to the attached drawings).

BRIEF DESCRIPTION OF THE DRAWINGS

FIGS. 6A and 6B are views useful in explaining feature extraction data, which is generated by the abnormality prediction system in FIG. 1, and details of a process using the feature extraction data.

DESCRIPTION OF THE EMBODIMENTS

The present invention will now be described in detail below with reference to the accompanying showing an embodiment thereof.

Figure 1:
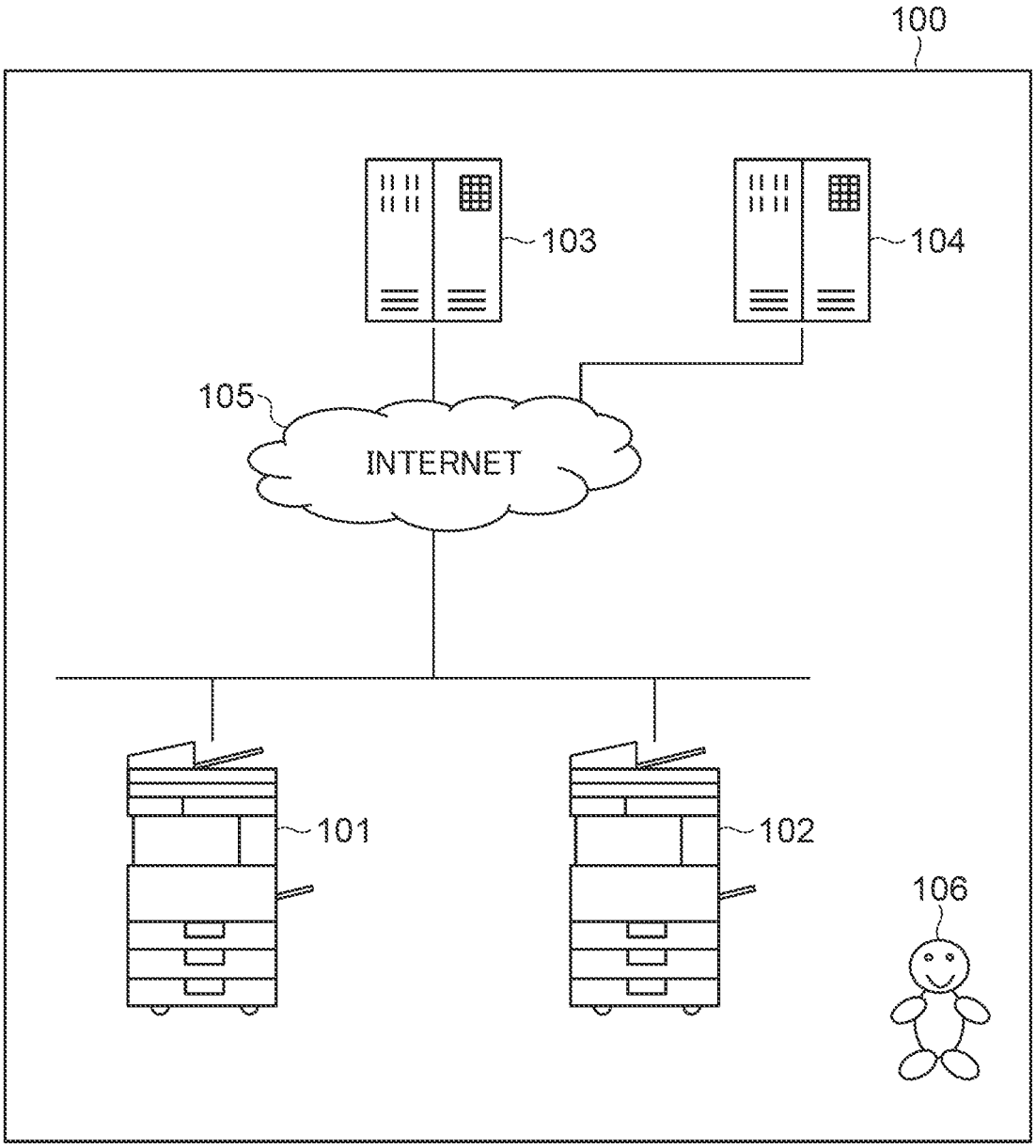
FIG. 1 is a view schematically showing an arrangement of an abnormality prediction system that is a management system according to an embodiment of the present invention.

FIG. 1 is a view schematically showing an arrangement of an abnormality prediction system 100 that is a management system according to the embodiment of the present invention. The abnormality prediction system 100 has one or more image forming apparatuses, a server 103, and a management apparatus 104. In the following description of the present embodiment, it is assumed that the abnormality prediction system 100 has, for example, two image forming apparatuses 101 and 102. The image forming apparatuses 101 and 102, the server 103, and the management apparatus 104 are capable of communicating with one another via the Internet 105. The abnormality prediction system 100 collects data from the image forming apparatuses 101 and 102, and based on the collected data, detects signs of abnormality in the image forming apparatuses 101 and 102.

The image forming apparatuses 101 and 102, which are for example MFPs, have a plurality of functions such as a scanning function, a printing function, a copying function, and a fax communication function. In the present embodiment, the image forming apparatuses 101 and 102 have the same functions and arrangement, and hence the functions and arrangement of the image forming apparatus 101 will be described below as an example.

The image forming apparatus 101 receives a function selecting operation performed by a user and also executes a job submitted by the user. Examples of the job executed by the image forming apparatus 101 include a scan job, a print job, a copy job, and a fax transmission job. The image forming apparatus 101 transmits log data 310 and/or feature extraction data 311 in FIG. 3, which will be described later, required to detect a sign of abnormality in the image forming apparatus 101, to the server 103 on a regular basis.

The server 103 stores (accumulates) the log data 310 and the feature extraction data 311 received from each of the image forming apparatuses 101 and 102. The server 103 transmits the stored (accumulated) log data 310 and the stored (accumulated) feature extraction data 311 to the management apparatus 104.

Upon receiving, for example, the log data 310 and the feature extraction data 311 of the image forming apparatus 101 from the server 103, the management apparatus 104 analyzes the received feature extraction data 311 and detects a sign of abnormality in the image forming apparatus 101. Specifically, the management apparatus 104 predicts failures, lifetimes, etc., of various components which the image forming apparatus 101 has. As a result of the prediction, when it is necessary to replace a component of the image forming apparatus 101, the management apparatus 104 requests a maintenance inspector 106 to perform maintenance of the image forming apparatus 101. Thus, in the present embodiment, regarding the image forming apparatus 101 to be managed by the abnormality prediction system 100, maintenance such as replacement can be performed for the component approaching the end of its life before a component provided in the image forming apparatus 101 fails.

Figure 2:
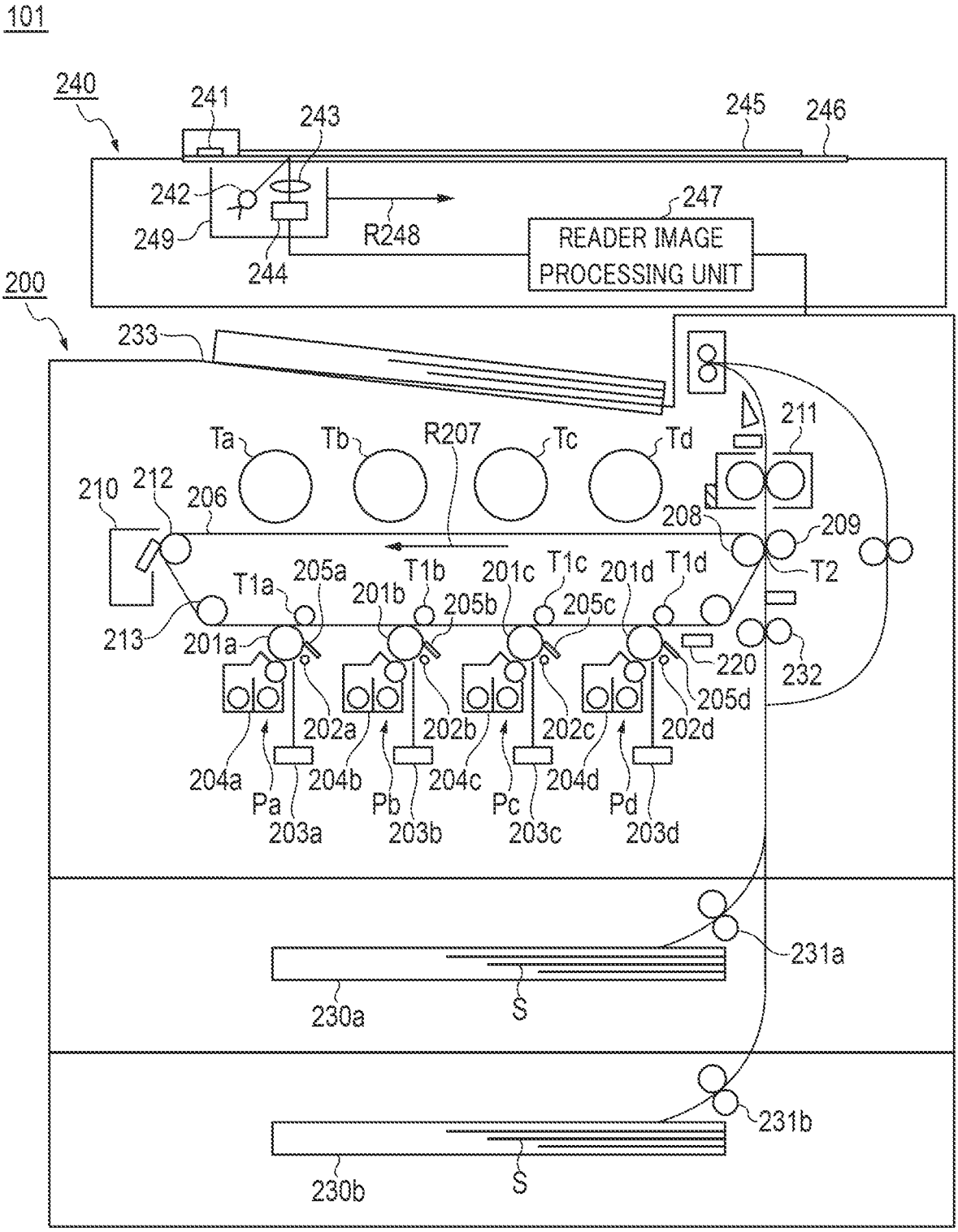
FIG. 2 is a side view of an image forming apparatus in FIG. 1.

FIG. 2 is a side view of the image forming apparatus 101 in FIG. 1. It should be noted that for ease of understanding, an internal arrangement of the image forming apparatus 101 is shown in perspective in FIG. 2. Referring to FIG. 2, the image forming apparatus 101 has a printer unit 200 and a reader unit 240.

The reader unit 240 is a scanner that reads an image formed on an original 245. The original 245 is placed on an original platen glass 246 such that its surface with an image formed thereon is in contact with the original platen glass 246. The reader unit 240 transmits image data, which represents the read image, to the printer unit 200. The reader unit 240 has a reading unit 249 and a reader image processing unit 247.

The reading unit 249 is configured as one unit comprised of a light emitting unit 242, an optical system 243, and a light receiving unit 244. The reading unit 249, which is, for example, a line sensor extending toward the rear in the figure, reads an image on the original 245 while moving in a direction indicated by an arrow R248. The light emitting unit 242 illuminates the original 245. The light receiving unit 244 receives light, which is reflected from the original 245, via the optical system 243. The light receiving result is transmitted to the reader image processing unit 247. Based on the received light receiving result, the reader image processing unit 247 generates image data representing the image formed on the original 245. The reader image processing unit 247 also functions as a sensor that measures an image density of the image formed on the original 245 based on the received light receiving result. The reader image processing unit 247 transmits the image data and the measured image density to the printer unit 200.

The image forming apparatus 101 forms a color image through an electrophotographic method. The image forming apparatus 101 uses an intermediate transfer tandem method, and in the printer unit 200, four image forming units Pa to Pd are disposed in tandem on an intermediate transfer belt 206 (transfer body). The image forming unit Pa forms a yellow toner image. The image forming unit Pb forms a magenta toner image. The image forming unit Pc forms a cyan toner image. The image forming unit Pd forms a black toner image. It should be noted that the number of colors formed is not limited to four.

Recording materials S such as sheets, each on which an image is formed, are stacked inside recording material cassettes 230*a* and 230*b* of the printer unit 200. The recording material S is fed, when the image forming units Pa to Pd perform image forming, from the recording material cassette 230*a* (or the recording material cassette 230*b*) by sheet feeding rollers 231*a* (or sheet feeding rollers 231*b*) adopting the friction separating method. The sheet feeding rollers 231*a* and 231*b* convey the recording materials S to registration rollers 232 via a conveying path. The registration rollers 232 correct for skewing of the recording materials S, adjust timing, and convey the recording materials S to a secondary transfer unit T2.

In the printer unit 200, an image is formed by the image forming units Pa to Pd. In the present embodiment, the image forming units Pa to Pd have the same arrangement, and hence their arrangement will be described below using the image forming unit Pa as an example. The image forming unit Pa has a photosensitive body 201*a*, a charging device 202*a*, an exposure device 203*a*, a developing device 204*a*, a primary transfer unit T1*a*, and a photosensitive body cleaner 205*a*. The charging device 202*a* uniformly charges a surface of the photosensitive body 201*a* which is rotationally driven. The exposure device 203*a* modulates light based on image data received from the reader unit 240 and irradiates the photosensitive body 201*a* with the modulated light. As a result, an electrostatic latent image corresponding to the image data is formed on the photosensitive body 201*a*.

The developing device 204*a* develops the electrostatic latent image, which is formed on the photosensitive body 201*a*, with a developer. In the present embodiment, toner is used as the developer. It should be noted that the developing device 204*a* according to the present embodiment holds a two-component developer in which nonmagnetic toner and a magnetic carrier are mixed, but may hold a one-component developer comprised of magnetic toner or nonmagnetic toner. By toner being attached to the photosensitive body 201*a* on which the electrostatic latent image is formed, a toner image is formed on the photosensitive body 201*a*. When a predetermined amount of pressure and a predetermined amount of electrostatic load bias are applied to the primary transfer unit T1*a*, the primary transfer unit T1*a* transfers the toner image formed on the photosensitive body 201*a* to the intermediate transfer belt 206. Likewise, toner images formed on the photosensitive bodies 201*b* to 201*d* are transferred to the intermediate transfer belt 206. Here, the toner images formed on the respective photosensitive bodies 201*a* to 201*d* are transferred to the intermediate transfer belt 206 such that they are superposed. Thus, the yellow, magenta, cyan, and black toner images are transferred to the intermediate transfer belt 206 such that they are superposed, forming a full-color toner image. Toner remaining on the photosensitive bodies 201*a* to 201*d* after the transfer is collected by the photosensitive body cleaners 205*a* to 205*d*. In the printer unit 200, when the amount of toner held in, for example, the developing device 204*a* has become equal to or smaller than a predetermined amount, the developing device 204 is replenished with toner from a toner bottle Ta which is a developer replenishment container.

The intermediate transfer belt 206, which is provided on an intermediate transfer belt frame (not shown), is an endless belt stretched by a secondary transfer internal roller 208, a tension roller 212, and a secondary transfer upstream roller 213. The intermediate transfer belt 206 is rotationally driven in a direction indicated by an arrow R207 by the secondary transfer internal roller 208, the tension roller 212, and the secondary transfer upstream roller 213. By rotating, the intermediate transfer belt 206 with the toner image in full color formed thereon conveys the toner image to the secondary transfer unit T2.

The recording material S and the toner image formed on the intermediate transfer belt 206 are conveyed with such timing that they join each other in the secondary transfer unit T2. The secondary transfer unit T2 is a transfer nip unit formed by the secondary transfer internal roller 208 and a secondary transfer external roller 209, which are disposed so as to face each other. By applying a predetermined amount of pressure and a predetermined amount of electrostatic load bias, the secondary transfer unit T2 causes the toner image to be adsorbed onto the recording material S. The secondary transfer unit T2 thus transfers the toner image on the intermediate transfer belt 206 onto the recording material S. Toner remaining on the intermediate transfer belt 206 after the transfer is collected by a transfer cleaner 210.

The recording material S onto which the toner image has been transferred is conveyed from the secondary transfer unit T2 to a fixing device 211 by the secondary transfer external roller 209. The fixing device 211 applies a predetermined amount of pressure and predetermined-temperature heat to the recording material S within a fixing nip formed by rollers facing each other, and fuses and fixes the toner image on the recording material S. The fixing device 211 has a heater (not shown), which is a heat source, and is controlled to be maintained at an optimum temperature. The recording material S on which the toner image has been fixed is discharged onto a sheet discharge tray 233. To form images on both sides of the recording material S, the recording material S is inverted by an inverting conveyance mechanism and conveyed to the registration rollers 232, and another toner image is formed on a side of the recording material S on which the above toner image has not been fixed.

A density sensor 220 for detecting a toner density is provided in the vicinity of the intermediate transfer belt 206. The density sensor 220 is disposed at a location where it is able to detect toner patterns of the respective colors formed on the intermediate transfer belt 206, and more specifically, between the photosensitive body 201*d* and the secondary transfer external roller 209.

Figure 3:
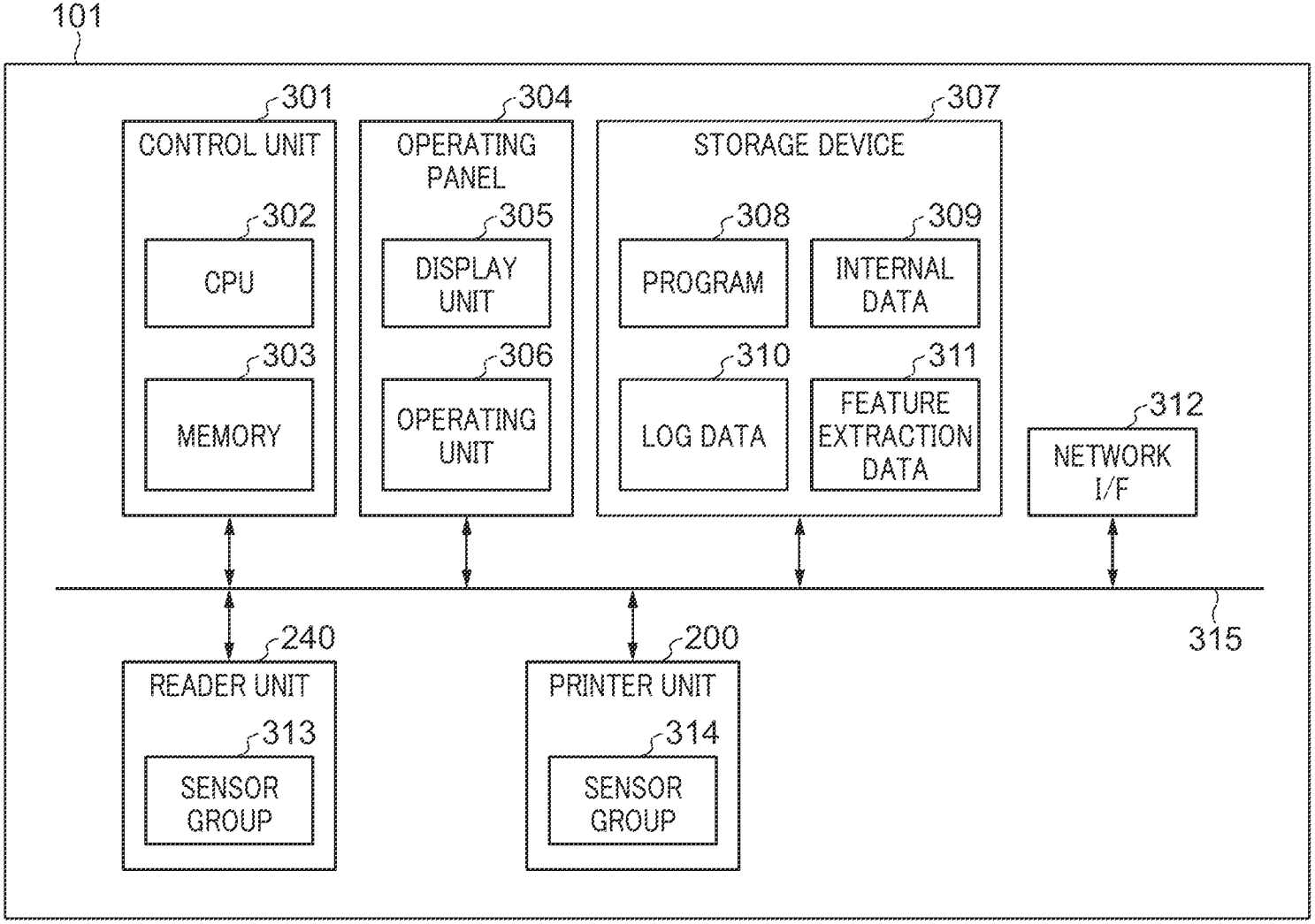
FIG. 3 is a block diagram schematically showing a hardware arrangement of the image forming apparatus in FIG. 1.

FIG. 3 is a block diagram schematically showing a hardware arrangement of the image forming apparatus 101 in FIG. 1. Referring to FIG. 3, the image forming apparatus 101 has a control unit 301, an operating panel 304, a storage device 307, and a network I/F 312 as well as the printer unit 200 and the reader unit 240 described above. The printer unit 200, the reader unit 240, the control unit 301, the operating panel 304, the storage device 307, and the network I/F 312 are connected to one another via a data bus 315.

The control unit 301 has a CPU 302 and a memory 303. The control unit 301 integratedly controls operation of the image forming apparatus 101. The CPU 302 is a hardware processor that executes various programs stored in the storage device 307. For example, when power to the image forming apparatus 101 is turned on, the CPU 302 reads a program 308 stored in the storage device 307 and executes the read program 308. As a result, the control unit 301 acts as a job control unit 501 and a data management unit 503 in FIG. 5, which will be described later. Also, a feature extraction data transmission control process in FIG. 9, which will be described later, is carried out by the CPU 302 executing the program 308. The memory 303 is used as a work area for the CPU 302 and as a temporary storage area for each piece of data.

The operating panel 304 has a display unit 305 and an operating unit 306. The display unit 305 is comprised of, for example, a color liquid crystal display, and displays various operating screens, which can be operated by the user and the maintenance inspector 106, and information required for maintenance. The operating unit 306 is comprised of, for example, touch panel keys displayed on the display unit 305 and receives operations performed by the user and the maintenance inspector 106.

The storage device 307 is a nonvolatile storage device and is, for example, a hard disk drive (HDD). The storage device 307 stores the program 308, internal data 309, log data 310, and feature extraction data 311. The internal data 309 is time-series data of sensor measured values obtained by various sensors which the reader unit 240 and the printer unit 200 have. The log data 310 is a data of, for example, job execution histories in the image forming apparatus 101 and includes detailed information about executed jobs, information about dates and times at which jobs were executed, and so forth. The feature extraction data 311 is generated based on the internal data 309. The feature extraction data 311 is data indicating characteristics of the image forming apparatus 101 and has a smaller data amount than that of the internal data 309. The network I/F 312 implements data communications via the Internet 105. The image forming apparatus 101 carries out communications with the server 103 via the network I/F 312.

The reader unit 240 has a sensor group 313. The sensor group 313 includes a plurality of sensors which monitors operating states of movable components operating when the reader unit 240 reads an original. In accordance with requests received from the control unit 301, the sensors included in the sensor group 313 output sensor measured values, which are obtained by measuring the operating states of the movable components, as one of pieces of the internal data 309 to the control unit 301. The printer unit 200 has a sensor group 314. The sensor group 314 includes a plurality of sensors, such as the density sensor 220, which monitors operating states of movable components operating when the printer unit 200 forms an image. In accordance with requests received from the control unit 301, the sensors included in the sensor group 313 output sensor characteristic values, which are obtained by measuring the operating states of the movable components, as one of pieces of the internal data 309 to the control unit 301.

A description will now be given of a hardware arrangement of the server 103 and the management apparatus 104. It should be noted that in the present embodiment, the server 103 and the management apparatus 104 have the same arrangement, and hence their arrangement will be described below by using the management apparatus 104 as an example.

Figure 4:
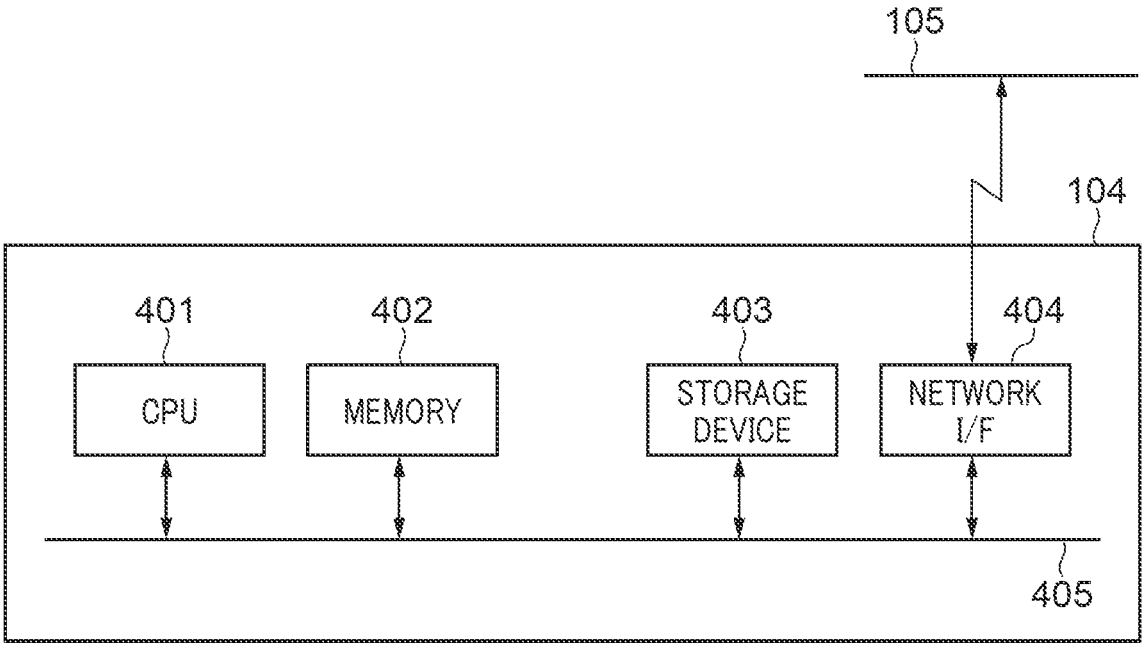
FIG. 4 is a block diagram schematically showing a hardware arrangement of a management apparatus in FIG. 1.

FIG. 4 is a block diagram schematically showing the hardware arrangement of the management apparatus 104 in FIG. 1. Referring to FIG. 4, the management apparatus 104 has a CPU 401, a memory 402, a storage device 403, and a network I/F 404. The CPU 401, the memory 402, the storage device 403, and the network I/F 404 are connected to one another via a system bus 405.

The CPU 401 is a central processing unit that controls the overall operation of the management apparatus 104. The memory 402 stores an activation program for the CPU 401 and data required to execute the activation program. The storage device 403 has a larger capacity than that of the memory 402 and is, for example, an HDD. It should be noted that the storage device 403 is not limited to an HDD but may be another storage device having functions equivalent to those of the HDD, for example, a solid-state drive (SSD). The storage device 403 stores a control program which is executed by the CPU 401.

To activate the management apparatus 104, the CPU 401 executes an activation program stored in the memory 402. This activation program is a program for expanding the control program stored in the storage device 403 into the memory 402. Then, the CPU 401 executes the control program expanded into the memory 402 to perform various types of control. The CPU 401 uses the network I/F 404 to carry out data communications with other apparatuses such as the server 103 via the Internet 105. For example, based on data received from the image forming apparatus 101 using the network I/F 404, the management apparatus 104 is capable of sharing a screen displayed on the operating panel 304 of the image forming apparatus 101 and displaying this screen on a display unit of the management apparatus 104.

Figure 5:
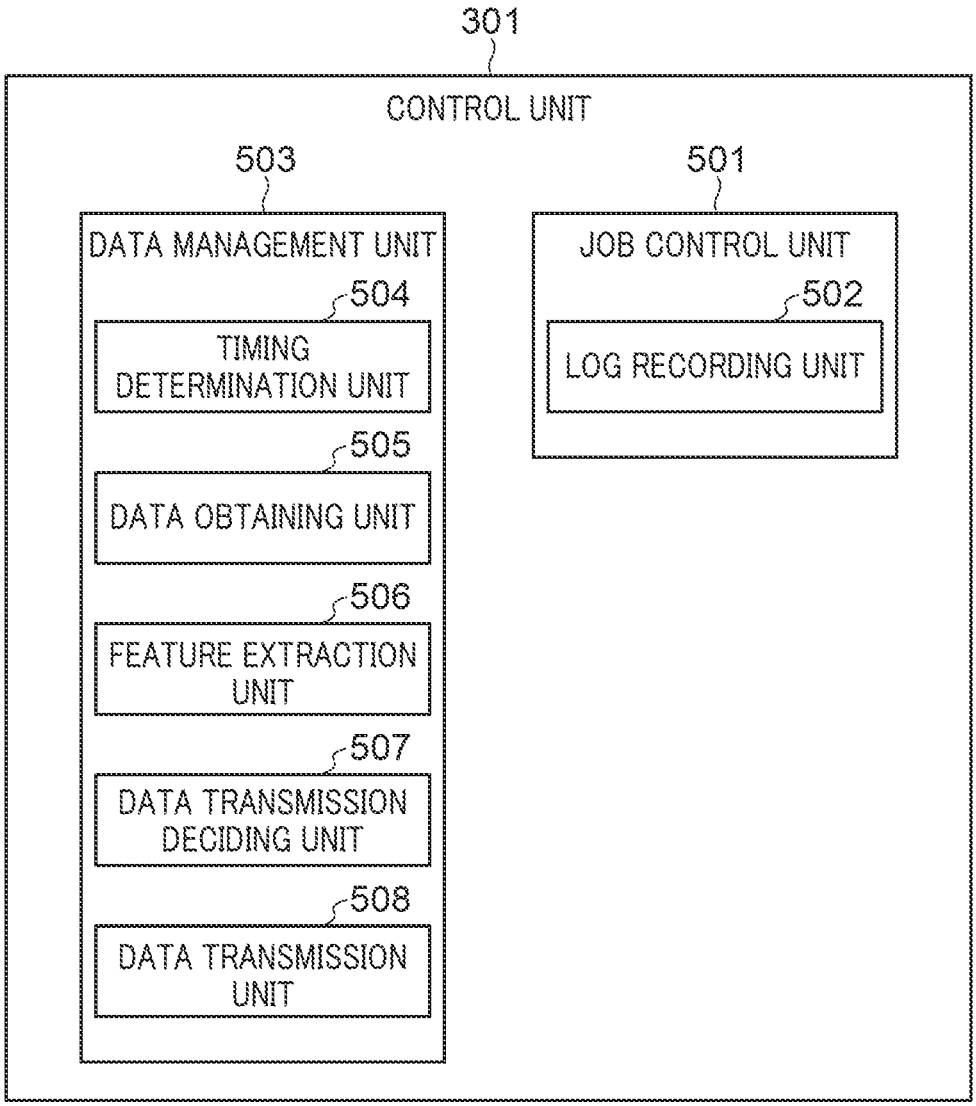
FIG. 5 is a block diagram showing a functional arrangement of a control unit in FIG. 2.

FIG. 5 is a block diagram showing a functional arrangement of the control unit 301 in FIG. 2. In the image forming apparatus 101, the execution of the control program 308 by the CPU 302 causes the control unit 301 to function as the job control unit 501 and the data management unit 503.

The job control unit 501 controls execution of a job in the image forming apparatus 101. By controlling operation of the reader unit 240 and the printer unit 200, the job control unit 501 controls execution of a job submitted by the user. The job control unit 501 includes a log recording unit 502.

When a job submitted by the user is executed, the log recording unit 502 records a job execution log as the log data 310.

The data management unit 503 manages the internal data 309 and the feature extraction data 311. The data management unit 503 includes a timing determination unit 504, a data obtaining unit 505, a feature extraction unit 506, a data transmission deciding unit 507, and a data transmission unit 508.

The timing determination unit 504 determines whether or not it is time to transmit the feature extraction data 311 to the server 103 (hereafter referred to as "the data transmission time"). For example, when a predetermined time period set in advance has elapsed since the feature extraction data 311 was transmitted to the server 103 the last time (hereafter referred to as "the previous transmission of the feature extraction data 311"), the timing determination unit 504 determines that it is the data transmission time.

The data obtaining unit 505 obtains, from the storage device 307, the internal data 309 for use in generating the feature extraction data 311 which is to be transmitted to the server 103. Specifically, the data acquisition unit 505 outputs data obtaining requests at predetermined times, which are defined for the respective sensors included in the sensor groups 313 and 314 described above, to the sensors and acquires sensor measured values from the respective sensors. It should be noted that the predetermined times may be every predetermined time, for example, interval of several milliseconds to several seconds or may be times before and after execution of a job submitted by the user. The data obtaining unit 505 obtains the log data 310 stored in the storage device 307.

The feature extraction unit 506 carries out a feature extraction process for converting the internal data 309 obtained by the data acquisition unit 505 to generate the feature extraction data 311. The data transmission deciding unit 507 carries out a data transmission deciding process in FIG. 11, which will be described later, to decide whether or not to transmit the generated feature extraction data 311 to the server 103. When the data transmission deciding unit 507 has decided to transmit the feature extraction data 311 to the server 103, the data transmission unit 508 transmits the feature extraction data 311 to the server 103. Thus, in the present embodiment, the feature extraction data 311 is transmitted to the server 103 only when it is the data transmission time and the data transmission deciding unit 507 decides to transmit the feature extraction data 311 to the server 103. As a result, when it is unnecessary to transmit the feature extraction data 311 to the server 103, the image forming apparatus 101 can be prevented from transmitting unnecessary data to the server 103, and hence communication load between the image forming apparatus 101 and the server 103 can be reduced.

FIGS. 6A and 6B are views useful in explaining feature extraction data, which is generated by the abnormality prediction system 100 in FIG. 1, and a process relating to the feature extraction data. FIG. 6A shows the relationship among the internal data 309, feature extraction processes that are carried out by the image forming apparatus 101, and abnormality prediction processes that are carried out by the management apparatus 104.

Referring to FIG. 6A, data items 601 represent data items of the internal data 309, and more specifically, names of items such as sensor measured values and count values obtained from the reader unit 240 and the printer unit 200 by the data obtaining unit 505. In the present embodiment, IDs for identifying the respective data items are assigned to the respective data items of the internal data 309.

Data sources 602 represent component elements in the image forming apparatus 101 which are sources of data in the data items 601. Data types 603 represent attributes of the data in the data items 601. Feature extraction processes 604 represent types of feature extraction processes in which the feature extraction data 311 is generated using the data in the data items 601. In FIG. 6A, the feature extraction processes 604 for the data items 601 for which the feature extraction data 311 is not generated, like scan counter, print counter, and log data, are represented by "-" which means that no feature extraction process is carried out.

Determination processes 605 represent types of abnormality prediction processes which are carried out by the management apparatus 104 based on the feature extraction data 311 generated using the data in the data items 601. In the abnormality prediction system 100, the types of the abnormality prediction processes are managed in association with data items of data used to generate the feature extraction data 311 used to the abnormality prediction processes. Prediction request IDs 606 are unique numbers correspondingly assigned to the abnormality prediction processes which are the determination processes 605. It should be noted that when the management apparatus 104 and the image forming apparatus 101, 102 are configured to share the numbers of the prediction request IDs 606, the numbers of the prediction request IDs 606 may be set for the respective abnormality prediction processes which are the determination processes 605 in advance, or the management apparatus 104 may regularly set the numbers of the prediction request IDs 606 for the respective abnormality prediction processes. Based on the numbers of the prediction request IDs 606, the management apparatus 104 determines types of abnormality prediction processes to be carried out. For example, when the maintenance inspector 106 has instructed the management apparatus 104 to carry out an abnormality prediction process with a prediction request ID "3" so as to check a state of a transfer roller in the image forming apparatus 101, the management apparatus 104 decides to carry out the abnormality prediction process corresponding to the prediction request ID "3", which is for obtaining the dispersion ratio. The management apparatus 104 obtains the feature extraction data 311 corresponding to a running distance of the transfer roller, which is used to carry out the abnormality prediction process, from the server 103, and carries out the abnormality prediction process for obtaining the dispersion ratio based on the obtained feature extraction data 311.

FIG. 6B is a view showing an example of transmission data 607 which the image forming apparatus 101 in FIG. 1 transmits to the server 103. The transmission data 607 is comprised of the multiple feature extraction data 311. Referring to FIG. 6B, the transmission data 607 is comprised of data items 608 and specific values 609. Feature extraction data are set as the data items 608. Specific values for the feature extraction data in the data items 608 are set as the specific values 609, for every generation time of the internal data 309 which is the basis of the feature extraction data. With this arrangement, it is possible to identify that the feature extraction data was generated based on which generation time of the internal data 309. For example, a value "y" (80), which is a result obtained by carrying out a maximum value calculation process for calculating a maximum value of sensor measured values representing temperatures of the fixing device 122 measured from a measurement time "t" (01/01/2020/00:00:00) to a predetermined measurement time is set in the transmission data 607 in FIG. 6B. Also, as the result of carry out of a histogram creating process using a predetermined rule on a sensor measured value representing a running distance of the transfer roller until the measurement time "t" (01/01/2020/00:00:00), for example, that a classification group in a histogram creating process is to be (80) is set in the transmission data 607 in FIG. 6B. The image forming apparatus 101 converts the transmission data 607 to generate data in text format and also compresses the generated data in text format if necessary and transmits the compressed data to the server 103.

Figure 7:
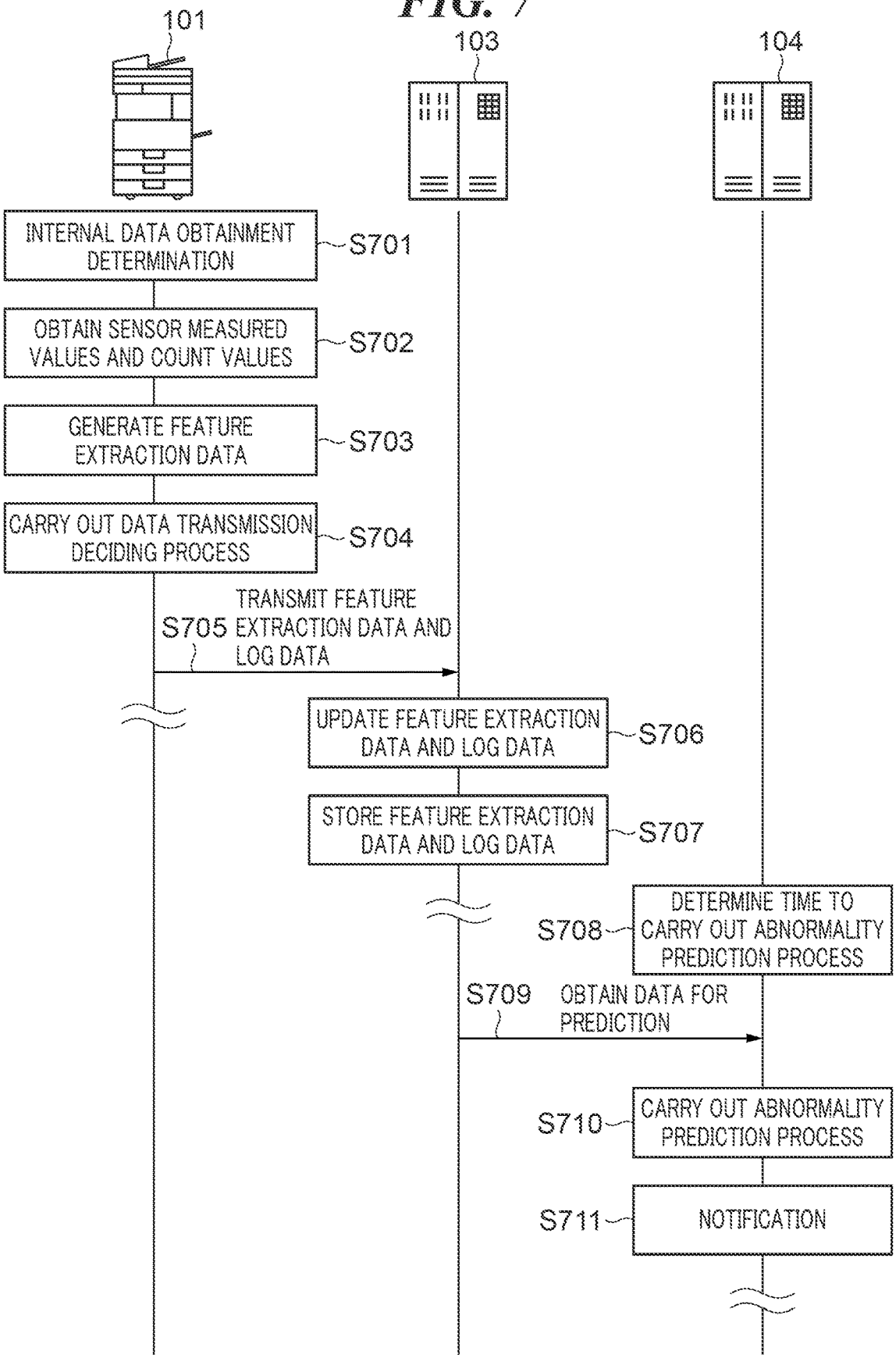
FIG. 7 is a sequence diagram useful in explaining the flow of a sequential process in which in the abnormality prediction system in FIG. 1, feature extraction data is generated, and notification of the need for maintenance is provided.

FIG. 7 is a sequence diagram useful in explaining the flow of a sequential process in which the feature extraction data 311 is generated, and notification of the need for maintenance is provided in the abnormality prediction system 100 in FIG. 1.

Figure 8A:
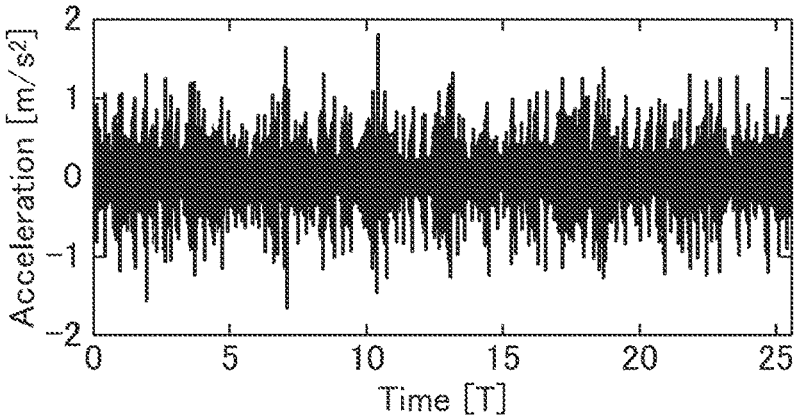
FIG. 8A to 8D are views showing examples of internal data and feature extraction data generated by the image forming apparatus in FIG. 1.

Referring to FIG. 7, the image forming apparatus 101 makes an internal data obtainment determination (step S701) to determine whether or not it is time to obtain sensor measured values and count values from the reader unit 240 and the printer unit 200 (hereafter referred to as "the internal data obtainment time"). Upon determining that it is the internal data obtainment time, the image forming apparatus 101 obtains data such as sensor measured values and count values from the reader unit 240 and the printer unit 200 (step S702) to generate the internal data 309 including the obtained data. In the internal data 309, time-series data comprised of a plurality sensor measured values and count values are managed with respect to each item. FIG. 8A shows rotational accelerations of a fixing belt motor at times T, which are examples of the time-series data comprised of the sensor measured values included in the internal data 309, with a horizontal axis representing time (T) and a vertical axis representing rotational accelerations.

Figure 8B:
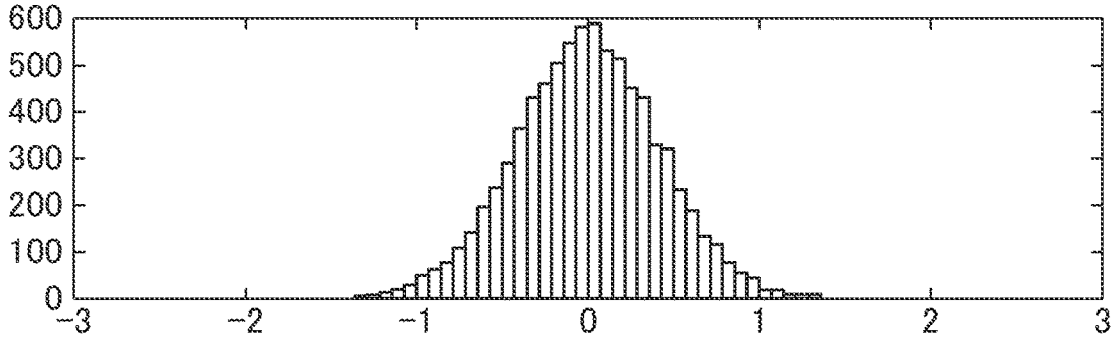

Next, the image forming apparatus 101 generates the feature extraction data 311 based on the internal data 309 comprised of the obtained sensor measured values and count values (step S703). For example, the image forming apparatus 101 generates the feature extraction data 311 in FIG. 8B by carrying out a histogram creating process on the time-series data comprised of the rotational accelerations of the fixing belt motor in FIG. 8A, which are the sensor measured values included in the internal data 309. Thus, by carrying out the histogram creating process on the rotational accelerations of the fixing belt motor, data indicating characteristics relating to appearance frequencies of the sensor measured values representing the rotational accelerations of the fixing belt motor and having a smaller data amount than that of the internal data 309 can be obtained.

Then, the image forming apparatus 101 carries out the data transmission deciding process in FIG. 11 (step S704), which will be described later, to decide whether or not to allow transmission of the feature extraction data 311. When deciding to allow transmission of the feature extraction data 31, the image forming apparatus 101 transmits the feature extraction data 311 and the log data 310 to the server 103 (step S705). In the step S705, the image forming apparatus 101 may transmit the transmission data 607 comprised of the multiple feature extraction data 311 to the server 103. Alternatively, the image forming apparatus 101 may transmit the feature extraction data 311 updated from previously transmitted data among the multiple feature extraction data 311 to the server 103. After that, the image forming apparatus 101 carries out the process in the step S701. The image forming apparatus 101 thus repeatedly carries out the processes in the steps S701 to S705.

Upon receiving the feature extraction data 311 and the log data 310 from the image forming apparatus 101, the server 103 carries out a process in step S706. In the step S706, the server 103 updates the have-been-managed feature extraction data 311 and the log data 310 on the image forming apparatus 101 to the above-mentioned received feature extraction data 311 and log data 310. Then, the server 103 stores the updated feature extraction data 311 and log data 310 (step S707). After that, the server 103 carries out the process in the step S706. The feature extraction data 103 thus repeatedly carries out the processes in the steps S706 to S707.

Figure 8C:
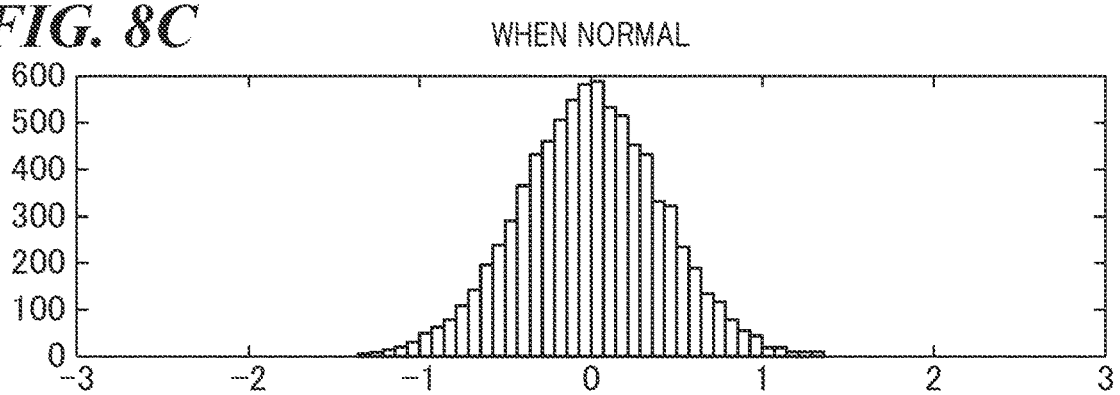
Figure 8D:
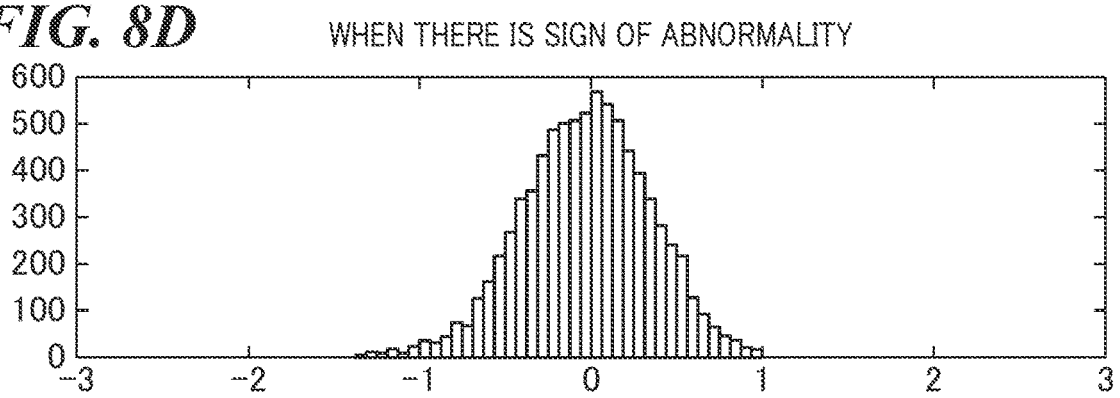

The management apparatus 104 carries out a process in step S1201, which will be described later, to determine whether or not it is time to carry out an abnormality prediction process (step S708). When determining that it is time to carry out an abnormality prediction process, the management apparatus 104 obtains prediction data, which is required to carry out the abnormality prediction process, from the server 103 (step S709). The prediction data is the feature extraction data 311 and the log data 310 on the image forming apparatus 101. Then, the management apparatus 101 carries out the abnormality prediction process associated with the obtained prediction data (step S710). For example, when obtaining, as the prediction data, the feature extraction data 311 in FIG. 8B obtained by carrying out the histogram creating process on the rotational accelerations of the fixing belt motor, the management apparatus 104 carries out a determination process using the dispersion ratio in the histogram as the abnormality prediction process, based on the obtained feature extraction data 311. For example, when the calculated dispersion ratio is equal to or greater than a predetermined dispersion ratio (e.g., FIG. 8C), the management apparatus 104 determines that the fixing belt motor is normal. On the other hand, when the calculated dispersion ratio is smaller than the predetermined dispersion ratio (e.g., FIG. 8D), the management apparatus 104 determines that there is a sign of abnormality in the fixing belt motor. It should be noted that although in the above description of the present embodiment, the method as an example was described, in which the management apparatus 104 performs the determination process on the feature extraction data 311 subjected to the histogram creating process, using the calculated dispersion ratio, the management apparatus 104 may carry out the determination process using another method using, for example, the average, the distortion ratio, and the kurtosis, not the dispersion ratio.

Referring again to FIG. 7, when determining that it is necessary to provide notification to the maintenance inspector 106 as a result of carrying out the abnormality prediction process, the management apparatus 104 provides notification to the maintenance inspector 106 (step S711). After that, the management apparatus 104 carries out the process in the step S708. The management apparatus 104 thus repeatedly carries out the processes in the step S708 to S711.

Figure 9:
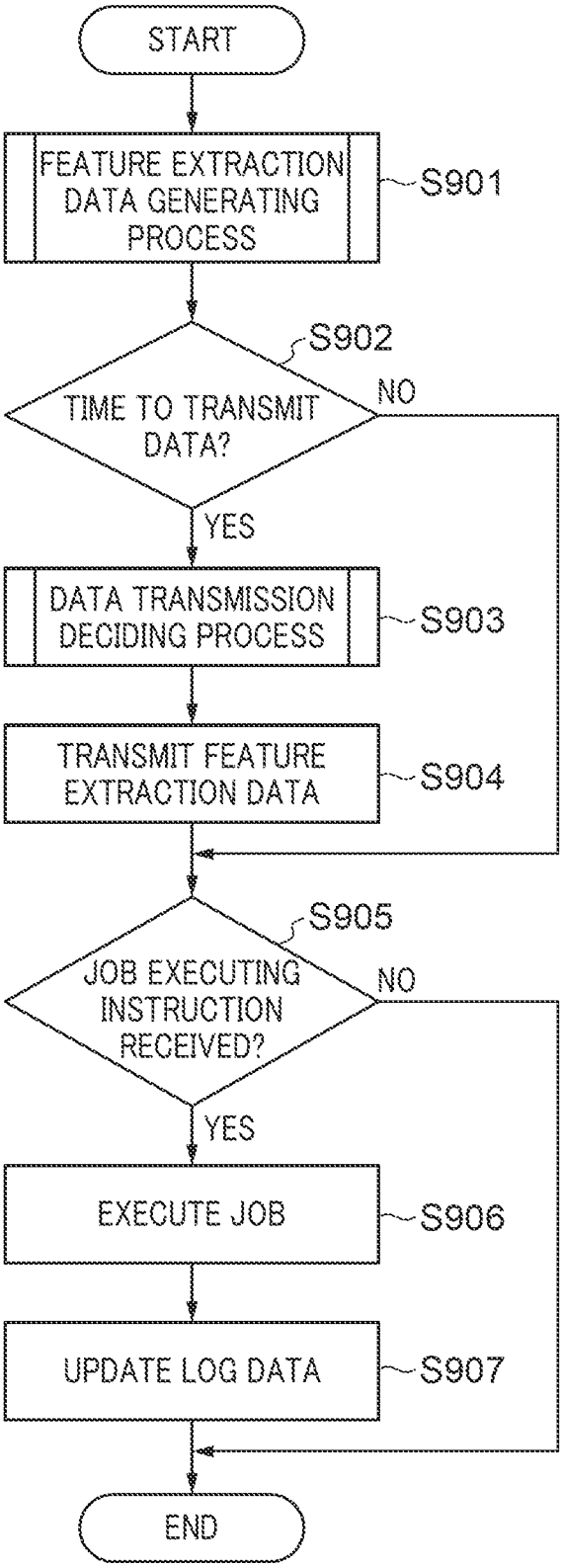
FIG. 9 is a flowchart showing the procedure of a feature extraction data transmission control process that is carried out by the image forming apparatus in FIG. 1.

FIG. 9 is a flowchart showing the procedure of the feature extraction data transmission control process that is carried out by the image forming apparatus 101 in FIG. 1. The process in FIG. 9 is implemented by the CPU 302 of the control unit 301 executing the program 308. The process in FIG. 9 is carried out at predetermined time intervals set in advance or on a regular basis at predetermined times set in advance. It should be noted that prior to the process in FIG. 9, the processes in the steps S701 and S702 described above have already been carried out, and the internal data 309 has already been generated.

Referring to FIG. 9, first, the control unit 301 carries out a feature extraction data generating process in FIG. 10 (step S901), which will be described later, to generate the feature extraction data 311 (see the step S703). Next, the control unit 301 determines whether or not it is the data transmission time (step S902). In the step S902, for example, when a predetermined time period set in advance has elapsed since the previous transmission of the feature extraction data 311, the control unit 301 determines that it is the data transmission time. On the other hand, when the predetermined time period has not elapsed, the control unit 301 determines that it is not the data transmission time.

As a result of the determination in the step S902, when it is not the data transmission time, the feature extraction data transmission control process proceeds to step S905. As a result of the determination in the step S902, when it is the data transmission time, the control unit 301 carries out process in step S903. In the step S903, the control unit 301 carries out the data transmission deciding process in FIG. 11, to be described later, to decide whether or not to allow transmission of the feature extraction data 311 to the server 103 (see the step S704).

When the transmission of the feature extraction data 311 to the server 103 is allowed in the step S903, the control unit 301 transmits the feature extraction data 311 generated in the step S901 to the server 103 (step S904) (see the step S705). In the step S904, as described above, the control unit 301 may transmit the transmission data 607 comprised of the multiple feature extraction data 311 to the server 103. Further, the control unit 301 may transmit the feature extraction data 311 updated since the previous transmission of the feature extraction data 311 among the multiple feature extraction data 311 to the server 103. When the transmission of the feature extraction data 311 is completed, the feature extraction data transmission control process proceeds to the step S905. On the other hand, when transmission of the feature extraction data 311 to the server 103 is not allowed, the feature extraction data transmission control process proceeds to the step S905 without the feature extraction data 311 being transmitted to the server 103. In the step S905, the control unit 301 determines whether or not a job executing instruction given by the user has been received.

As a result of the determination in the step S905, when a job executing instruction given by the user has been received, the control unit 301 executes a job instructed to execute by the user (step S906). Upon completing the execution of the job, the control unit 301 updates the log data 310 (step S907). Specifically, the control unit 301 sets an execution record of the job in the log data 310. Then, the control unit 301 transmits the updated log data to the server 103 (see the step S705). After that, the feature extraction data transmission control process is ended.

Figure 10:
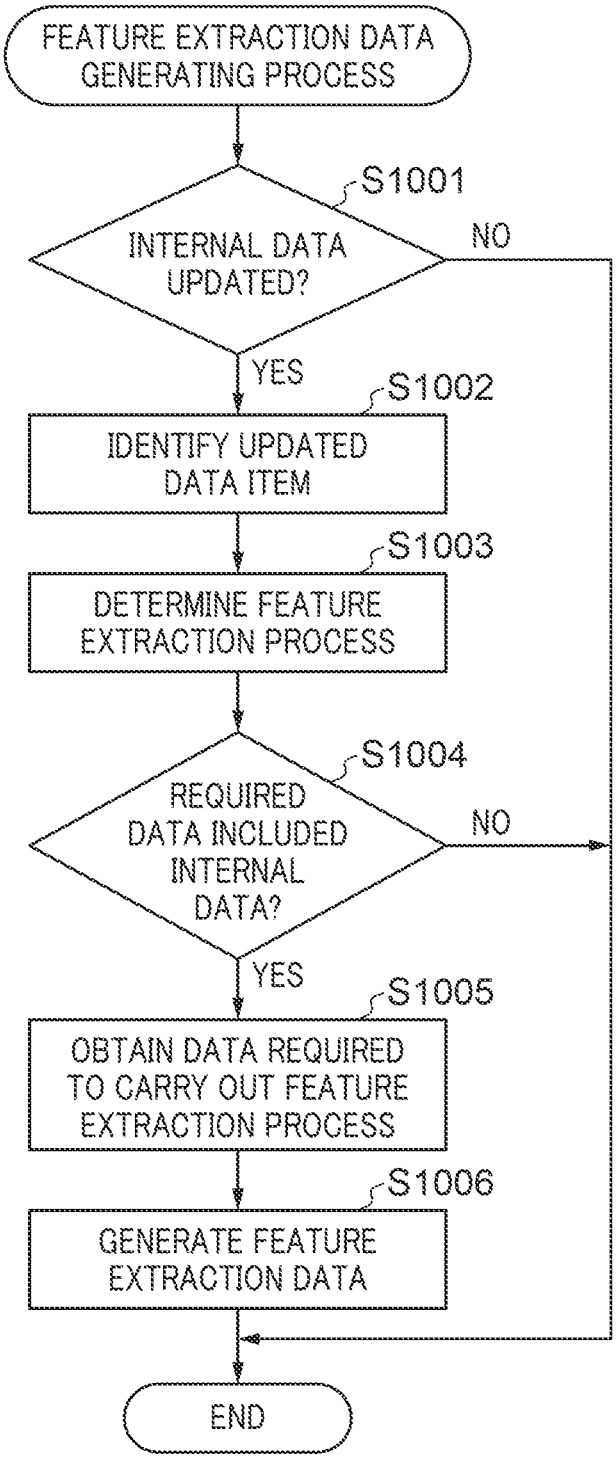
FIG. 10 is a flowchart showing the procedure of a feature extraction data generating process in step S901 in FIG. 9.

FIG. 10 is a flowchart showing the procedure of the feature extraction data generating process in the step S901 in FIG. 9.

Referring to FIG. 10, the control unit 301 reads the internal data 309 from the storage device 307 and determines whether or not the internal data 309 has been updated since the previous transmission of the feature extraction data 311 (step 1001).

As a result of the determination in the step S1001, when the internal data 309 has been updated since the previous transmission of the feature extraction data 311, the control unit 301 carries out a process in step S1002. In the step S1002, the control unit 301 identifies a data item that has been updated since the previous transmission of the feature extraction data 311 in the internal data 309. Next, the control unit 301 determines a feature extraction process to be carried out (step S1003). For example, when the data item identified in the step S1002 is "fixing unit temperature" in FIG. 6A, the control unit 301 determines that the feature extraction process to be carried out as a "maximum value calculation process" for generating feature extraction data of the identified item. In a case where a plurality of data items is identified in the step S1002, the control unit 301 determines feature extraction processes to be carried out for the respective ones of the identified data items.

Then, the control unit 301 determines whether or not data required to carry out the determined feature extraction process is included in the internal data 309 (step S1004). Here, for example, in the maximum value calculation process and a moving-average process, not only the latest data of the identified data item but also past data for a predetermined time period before that or a predetermined number of past data are required. Thus, in the present embodiment, since the number of data required to carry out varies with feature extraction processes, the number of data required to carry out each feature extraction process is managed in a management table (not shown). In the step S1004, it is determined whether or not the data required to carry out the determined feature extraction process including the past data is included in the internal data 309.

As a result of the determination in the step S1004, when the data required to carry out the determined feature extraction process is included in the internal data 309, the control unit 301 obtains data required to carry out the determined feature extraction process from the internal data 309 (step S1005). Then, the control unit 301 carries out the feature extraction process determined in the step S1003 to generate the feature extraction data 311 (step S1006) and ends the feature extraction data generating process.

As a result of the determination in the step S1001, when the internal data 309 has not been updated since the previous transmission of the feature extraction data 311, or as a result of the determination in the step S1004, when the data required to carry out the determined feature extraction process is not included in the internal data 309, the feature extraction data generating process is ended without the feature extraction data 311 being generated.

Figure 11:
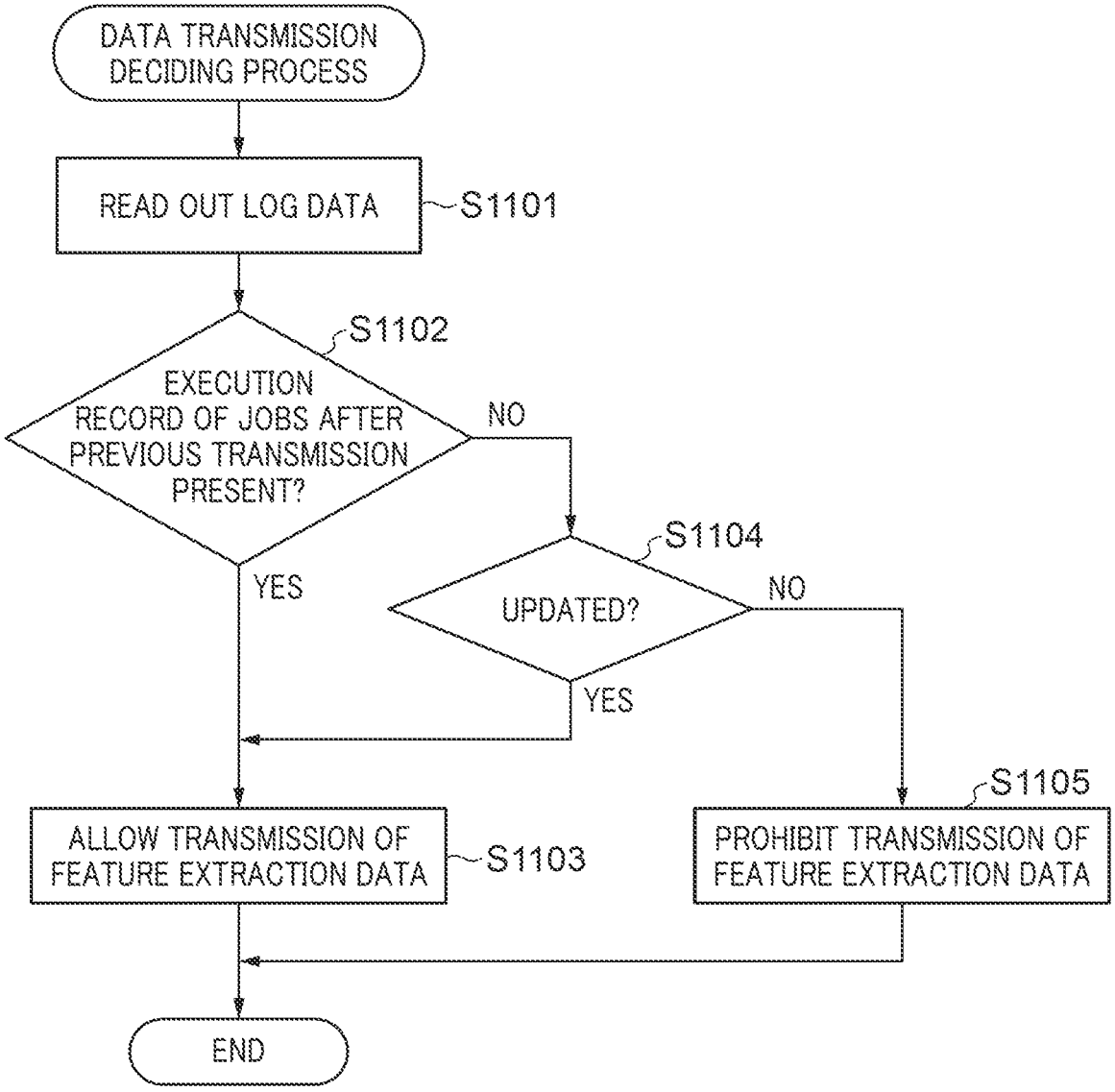
FIG. 11 is a flowchart showing the procedure of a data transmission deciding process in step S903 in FIG. 9.

FIG. 11 is a flowchart showing the procedure of the data transmission deciding process in the step S903 in FIG. 9.

Referring to FIG. 11, the control unit 301 reads the log data 310 from the storage device 307 (step S1101) and determines whether or not the log data 310 includes an execution record of jobs that have been executed since the previous transmission of the feature extraction data 311 (step S1102).

As a result of the determination in the step S1102, when the log data 310 includes an execution record of jobs that have been executed since the previous transmission of the feature extraction data 311, the control unit 301 allows transmission of the feature extraction data 311 (step S1103) and ends the data transmission deciding process.

As a result of the determination in the step S1102, when the log data 310 does not include an execution record of jobs that have been executed since the previous transmission of the feature extraction data 311, the control unit 301 carries out a process in step S1104. In the step S1104, the control unit 301 determines whether or not the feature extraction data 311 has been updated since the previous transmission, based on update date/time information included in the feature extraction data 311.

As a result of the determination in the step S1104, when the feature extraction data 311 has been updated since the previous transmission, the data transmission deciding process proceeds to the step S1103. As a result of the determination in the step S1104, when the feature extraction data 311 has not been updated since the previous transmission, the control unit 301 prohibits transmission of the feature extraction data 311 (step S1105). Namely, in the present embodiment, when it is time to transmit the feature extraction data 311 and the feature extraction data 311 generated in the step S901 is the same as feature extraction data transmitted the last time, the feature extraction data 311 generated in the step S901 is not transmitted to the server 103. After that, the data transmission deciding process is ended.

Figure 12:
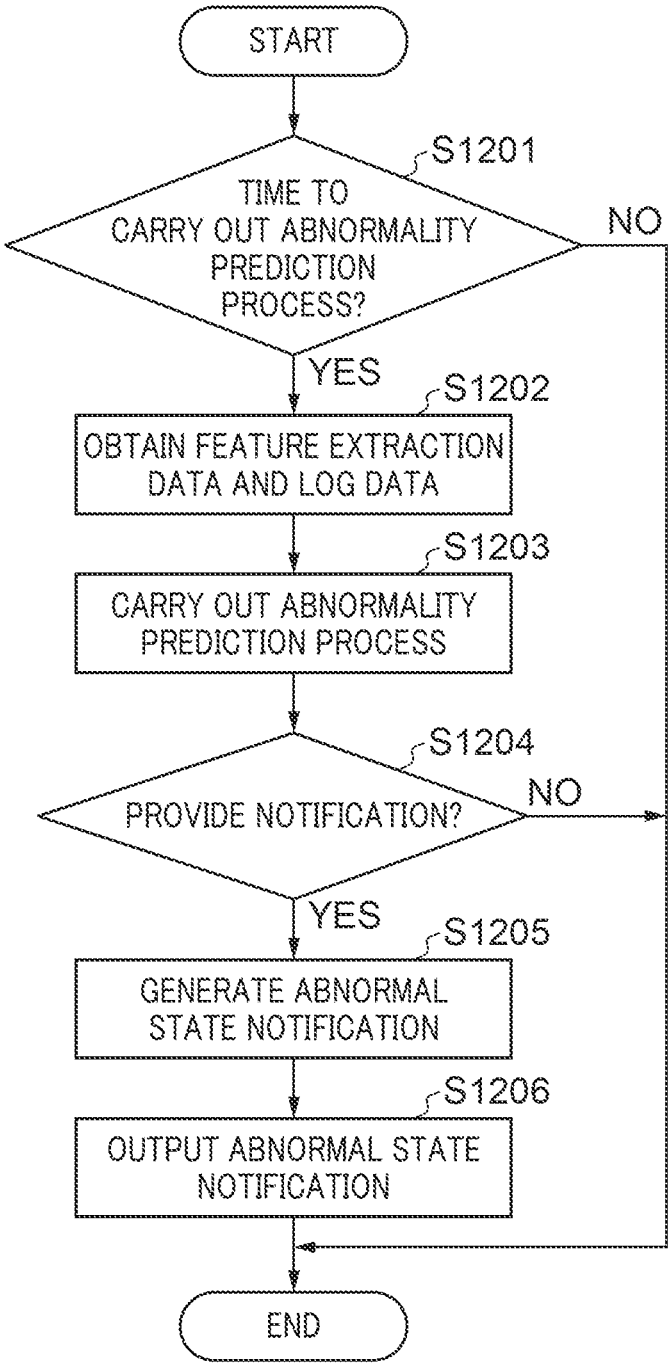
FIG. 12 is a flowchart showing the procedure of an abnormality prediction control process that is carried out by the management apparatus in FIG. 1.

FIG. 12 is a flowchart showing the procedure of an abnormality prediction control process that is carried out by the management apparatus 104 in FIG. 1. The process in FIG. 12 is implemented by the CPU 401 of the management apparatus 104 executing a program stored in the memory 402 or the storage device 403.

Referring to FIG. 12, the CPU 401 determines whether or not it is time to carry out an abnormality prediction process (step S1201). In the present embodiment, with respect to prediction request IDs of abnormality prediction processes that can be carried out by the management apparatus 104, execution times such as predetermined time periods and predetermined times are set in advance. The management apparatus 104 can also receive a request to carry out an abnormality prediction process from the image forming apparatus 101 that is operated by the maintenance inspector 106 or the like. In the step S1201, when the time set in advance has come for an abnormality prediction process to be carried out, or when an execution request including a prediction request ID of an abnormality prediction process designated by the maintenance inspector 106 has been received from the image forming apparatus 101 or the like, the CPU 401 determines that it is time to carry out the abnormality prediction process. On the other hand, when the time set in advance has not come for an abnormality prediction process to be carried out and an execution request for an abnormality prediction process has not been received from the image forming apparatus 101 or the like, the CPU 401 determines that it is not time to carry out the abnormality prediction process.

As a result of the determination in the step S1201, when it is not time to carry out the abnormality prediction process, the abnormality prediction control process is ended. As a result of the determination in the step S1201, when it is time to carry out the abnormality prediction process, the CPU 401 obtains a prediction request ID for identifying the abnormality prediction process to be carried out. For example, when an execution request including a prediction request ID "2", which has been transmitted from the image forming apparatus 101 so that the maintenance inspector 106 can grasp a state of the fixing belt was received, the CPU 401 obtains this prediction request ID "2".

Next, the CPU 401 obtains the feature extraction data 311 and the log data 310 required to carry out an abnormality prediction process corresponding to the obtained prediction request ID (step S1202). Then, the CPU 401 carries out, based on the obtained feature extraction data 311 and log data 310, the abnormality prediction process corresponding to the obtained prediction request ID (step S1203) (abnormality sign detection means).

Figure 13A:
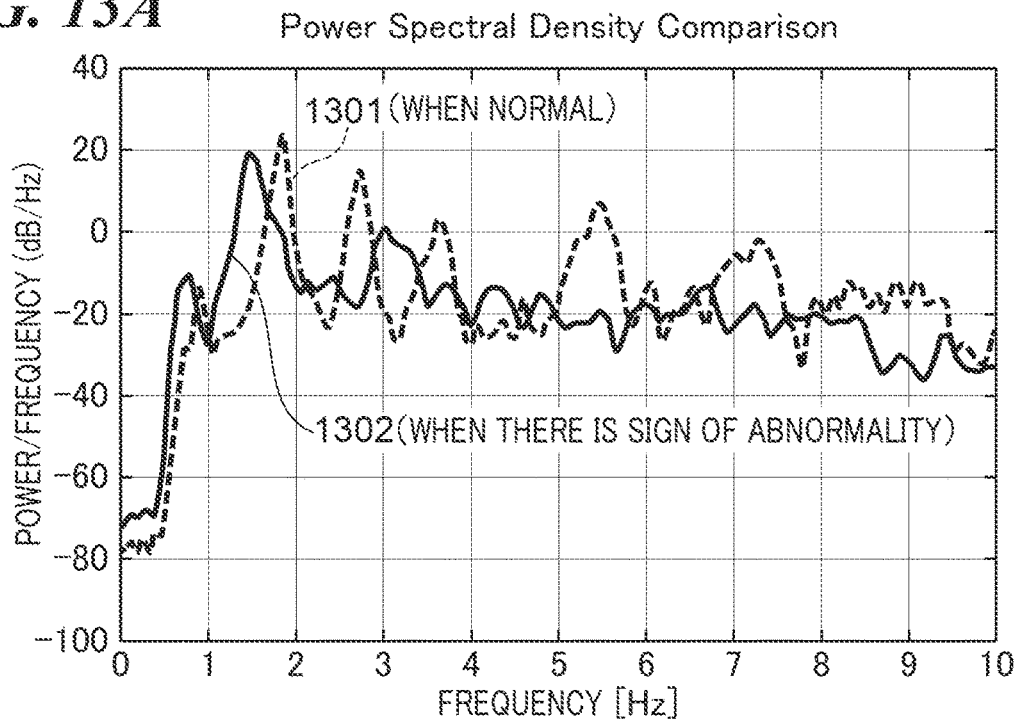
FIGS. 13A to 13C are views showing examples of execution results of a process in step S1203 in FIG. 12.

For example, as the abnormality prediction process corresponding to the obtained prediction request ID "2", the CPU 401 carries out a process in which it performs period analysis using the feature extraction data 311 that is generated by performing spectrum formation on time-series data on sensor measured values representing rotational accelerations of the fixing belt motor and determines whether or not an abnormality has occurred or there is a sign of abnormality. For example, when the period of a wave is equal to or smaller than a predetermined value as indicated by a dotted line 1301 in FIG. 13A, the CPU 401 determines that the fixing belt motor is normal. On the other hand, when the period of a wave is greater than the predetermined value as indicated by a solid line 1302 in FIG. 13A, the CPU 401 determines that there is a sign of abnormality in the fixing belt motor. Thus, in the present embodiment, whether or not there is a sign of abnormality in the image forming apparatuses 101 is determined based on the feature extraction data 311, which indicates characteristics of frequency components in sensor measured values and has a smaller data amount than that of the internal data 309.

Figure 13B:
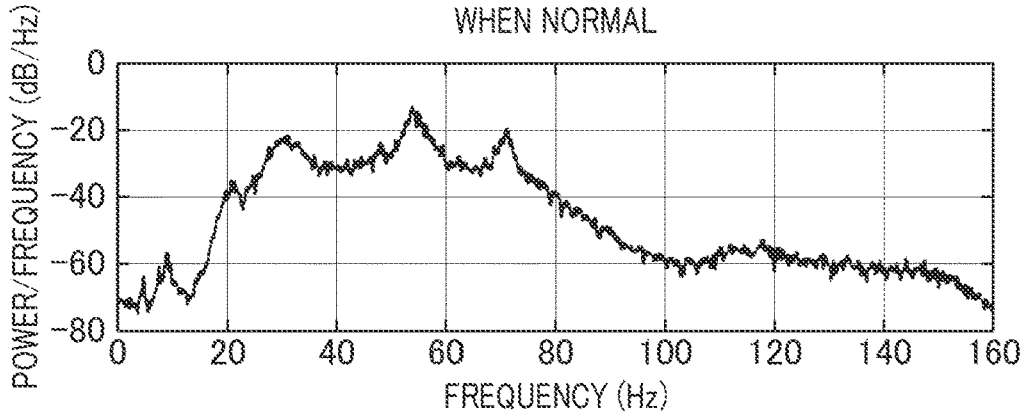
Figure 13C:
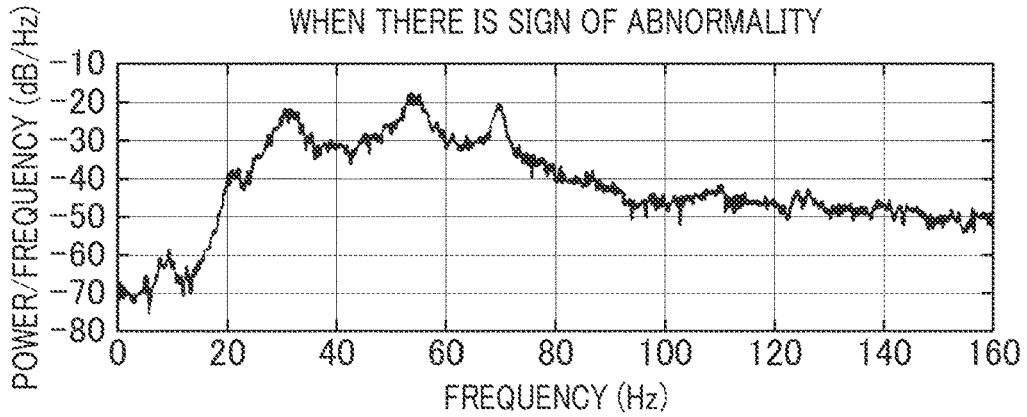

Further, the CPU 401 determines whether or not there is a sign of abnormality by performing a inclination analyzing process using the feature extraction data 311 obtained by on time-series data of sensor measured values, which represents the speed of the intermediate transfer belt, having been subjected to the moving-average process. For example, referring to FIG. 13B, when the inclination of a waveform is equal to or smaller than a predetermined value, the CPU 401 determines that the intermediate transfer belt is normal. On the other hand, referring to FIG. 13C, when the inclination of a waveform is greater than the predetermined value, the CPU 401 determines that there is a sign of abnormality in the intermediate transfer belt. Thus, in the present embodiment, by using the feature extraction data 311 generated by the moving-average process being carried out on sensor measured values, the trend of the sensor measured values can be grasped with only a small amount of data, and also, measurement errors in the sensor measured values can be reduced.

Then, the CPU 401 determines, based on an execution result of the abnormality prediction process, whether or not to provide notification to the maintenance inspector 106 (step S1204). In the step S1204, for example, when occurrence of an abnormality or a sign of abnormality has been detected by the abnormality prediction process, the CPU 401 determines to provide notification to the maintenance inspector 106. On the other hand, when occurrence of an abnormality or a sign of abnormality has not been detected by the abnormality prediction process, the CPU 401 determines not to provide notification to the maintenance inspector 106.

In the step S1204, when the CPU 401 determines not to provide notification to the maintenance inspector 106, the abnormality prediction control process is ended. In the step S1204, when the CPU 401 determines to provide notification to the maintenance inspector 106, the CPU 401 generates an abnormal state notification including, for example, information about a component whose abnormality has been detected (step S1205). Then, the CPU 401 outputs the abnormal state notification for the maintenance inspector 106 (step S1206) and ends the abnormality prediction control process.

According to the embodiment described above, the image forming apparatus 101 (or the image forming apparatus 102) transmits the feature extraction data 311 to the management apparatus 104 (indirectly) via the server 103. The feature extraction data 311 has a smaller data amount than that of the internal data 309. As a result, it is possible to keep down data traffic when the image forming apparatus 101 (or 102) transmits data to the management apparatus 104 via the server 103, and therefore, it is possible to keep down costs required to build and maintain a communication environment. The feature extraction data 311 is data indicating characteristics of the image forming apparatus 101 (or 102). Therefore, for the image forming apparatus 101 (or 102), it is possible to provide data that can be utilized for data analysis other than detection of a sign of abnormality. Namely, in the present embodiment, data that can be utilized for data analysis other than detection of a sign of abnormality can be provided to the management apparatus 104 while costs required to build and maintain a communication environment are kept down.

Moreover, in the embodiment described above, the abnormality prediction system 100 has the plurality of image forming apparatuses 101 and 102. Thus, when the server 103 collects the feature extraction data 311 from each of a plurality of image forming apparatuses placed in many places, the processing load for transmitting the feature extraction data 311 can be reduced. As a result, in the abnormality prediction system 100, processing can be efficiently performed when the server 103 collects the feature extraction data 311 as big data from many places around the world.

Furthermore, in the embodiment described above, the management apparatus 104 has the function of carrying out the abnormality prediction process. Here, in the abnormality prediction system 100, when not the management apparatus 104 but the image forming apparatuses 101 and 102 are configured to have the function of carrying out the abnormality prediction process, a large-capacity storage device and a computation device, for implementing the function of carrying out the abnormality prediction process, need to be incorporated into each of the image forming apparatuses 101 and 102. Therefore, regarding construct the abnormality prediction system 100, it costs more in a case where the image forming apparatuses 101 and 102 have the function of carrying out the abnormality prediction process, than in the case where the management apparatus 104 has the function of carrying out the abnormality prediction process. In the present embodiment, the management apparatus 104 has the function of carrying out the abnormality prediction process. Thus, costs required to construct the abnormality prediction system 100 can be reduced as compared to the case where the image forming apparatuses 101 and 102 have the function of carrying out the abnormality prediction process.

In the embodiment described above, when it is time to transmit the feature extraction data 311 and the feature extraction data 311 generated in the step S901 is the same data as feature extraction data transmitted the last time, the feature extraction data 311 generated in the step S901 is not transmitted to the server 103. Thus, in the abnormality prediction system 100, transmission of unnecessary data such as transmission of data which the server 103 already holds from the image forming apparatus 101 (or 102) to the server 103 can be prevented.

Moreover, in the embodiment described above, the feature extraction data 311 is data obtained by creating a histogram from the internal data 309. Thus, data that has a smaller data amount than that of the internal data 309 and indicates characteristics relating to the appearance frequency of sensor measured values can be provided to the management apparatus 104.

Furthermore, in the embodiment described above, the feature extraction data 311 is data obtained by performing spectrum formation on the internal data 309. Thus, data that has a smaller data amount than that of the internal data 309 and represents characteristics relating to frequency components of sensor measured values can be provided to the management apparatus 104.

Although the present invention has been described by way of the embodiment, the present invention should not be limited to the embodiment described above. For example, the abnormality prediction system 100 may have a structure in which the server 103 is not equipped and the image forming apparatus 101, 102 is configured to transmit the feature extraction data 311 directly to the management apparatus 104.

Moreover, although in the embodiment described above, the transmission data 607 obtained by aggregating the generated multiple feature extraction data 311 is transmitted to the server 103, the present invention is not limited to this. For example, the generated multiple feature extraction data 311 may be individually transmitted to the server 103.

Instead of the structure in the embodiment described above, the abnormality prediction system 100 may have a structure in which the management apparatus 104 obtains the latest feature extraction data 311 and at least one piece of the feature extraction data 311 generated prior to the generation of the latest feature extraction data 311 from the server 103 or the like and predicts a time when maintenance of the image forming apparatus 101 (or the image forming apparatus 102) will be required (hereafter referred to as "the maintenance time") based on the obtained multiple feature extraction data 311. A description will now be given of an example in which a maintenance time for the image forming apparatus 101 is predicted based on the feature extraction data 311 (second data) on the density sensor 220 obtained from the server 103.

Figure 14:
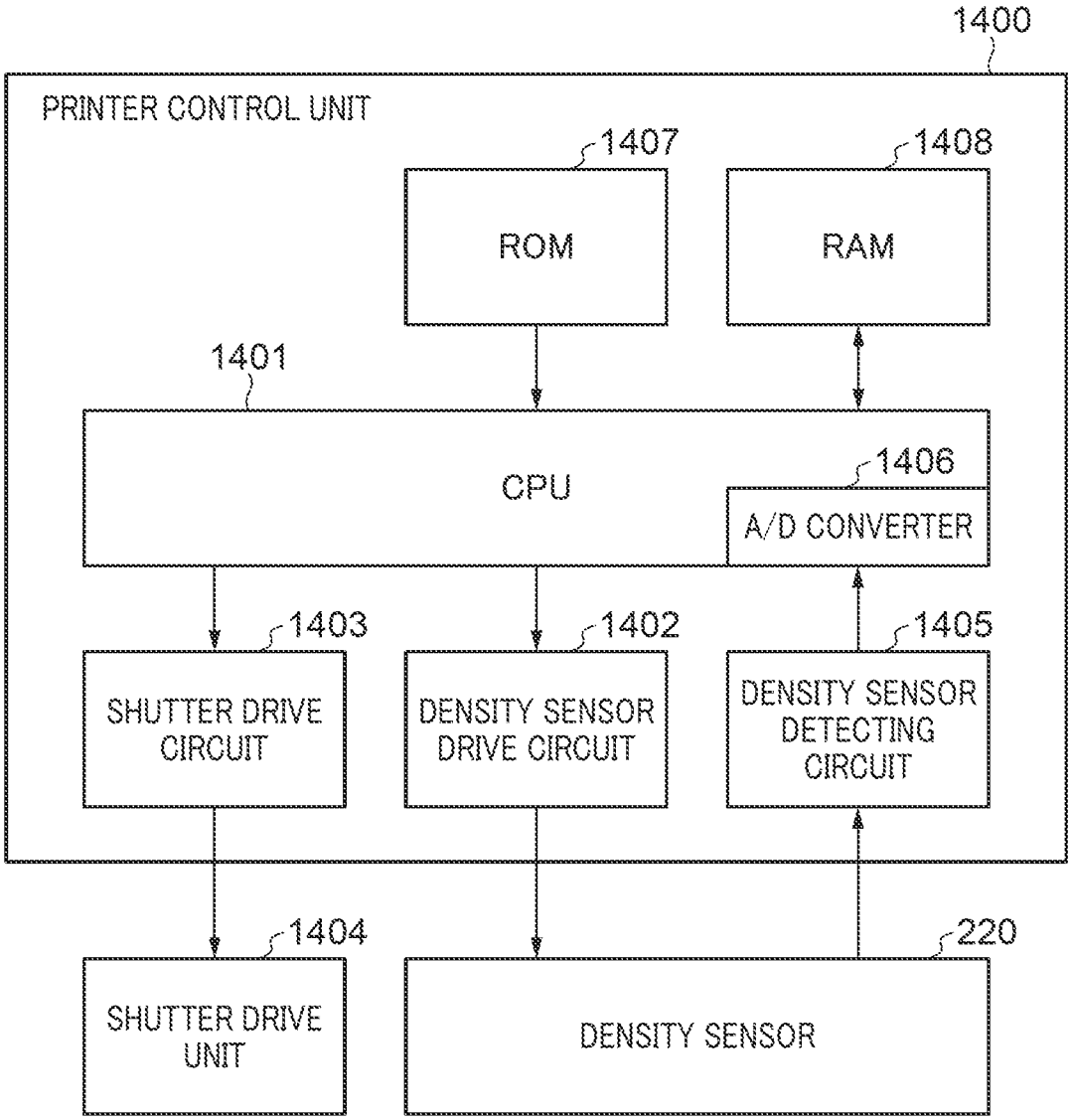
FIG. 14 is a block diagram schematically showing an arrangement of a printer control unit included in a printer unit in FIG. 2.

FIG. 14 is a block diagram schematically showing an arrangement of a printer control unit 1400 included in the printer unit 200 in FIG. 2. Referring to FIG. 14, the printer control unit 1400 has a CPU 1401, a density sensor drive circuit 1402, a shutter drive circuit 1403, a density sensor detecting circuit 1405, a ROM 1407, and a RAM 1408. The CPU 1401 is connected to the density sensor drive circuit 1402, the shutter drive circuit 1403, the density sensor detecting circuit 1405, the ROM 1407, and the RAM 1408.

The CPU 1401 has a function of generating a command signal for performing density correction control using the density sensor 220 and a function of carrying out a computation process relating to the density correction control. The density sensor 220, which is an optical sensor, detects densities of toner patterns formed on the intermediate transfer belt 206. The density sensor drive circuit 1402 has a function of controlling turning on and off a light-emitting diode (hereafter referred to as the "LED") 1501 and a photodiode (hereafter referred to as the "PD") 1502 in FIGS. 15A and 15B, which the density sensor 220 has, and controlling driving current for the LED 1501 and the PD 1502.

To perform the density correction control, the CPU 1401 controls the shutter drive circuit 1403 to transmit a drive signal to a shutter drive unit 1401 of the printer unit 200. The shutter drive unit 1401 that has received this drive signal performs control to open a shutter 1500 in FIG. 15, to be described later, which keeps the density sensor 220 from becoming dirty. The CPU 1401 also controls the density sensor drive circuit 1402 to transmit a drive signal to the density sensor 220. The density sensor 220 irradiates, based on the received drive signal, an object to be measured with light and detects reflected light from the object to be measured. The light detected by the density sensor 220 is subjected to I-V conversion. The density sensor circuit 1405 transmits signals indicating detection results received from the density sensor 220 to an A/D converter 1406 of the CPU 1401. The A/D converter 1406 captures, in time series, the signals transmitted from the density sensor circuit 1405, and subjects the captured signals to A/D conversion. The CPU 1401 performs computations for calculating density correction information by using a calculating formula stored in the ROM 1407 in advance and the signals subjected to the A/D conversion. The CUP 1401, based on the calculated density correction information, determines setting values in a lookup table, and based on the determined setting values, updates values stored in the RAM 1408 in advance. To form an image, the CPU 1401 reads a setting value in the lookup table from the RAM 1408 and forms the image under a condition corresponding to the read setting value.

Figure 15A:
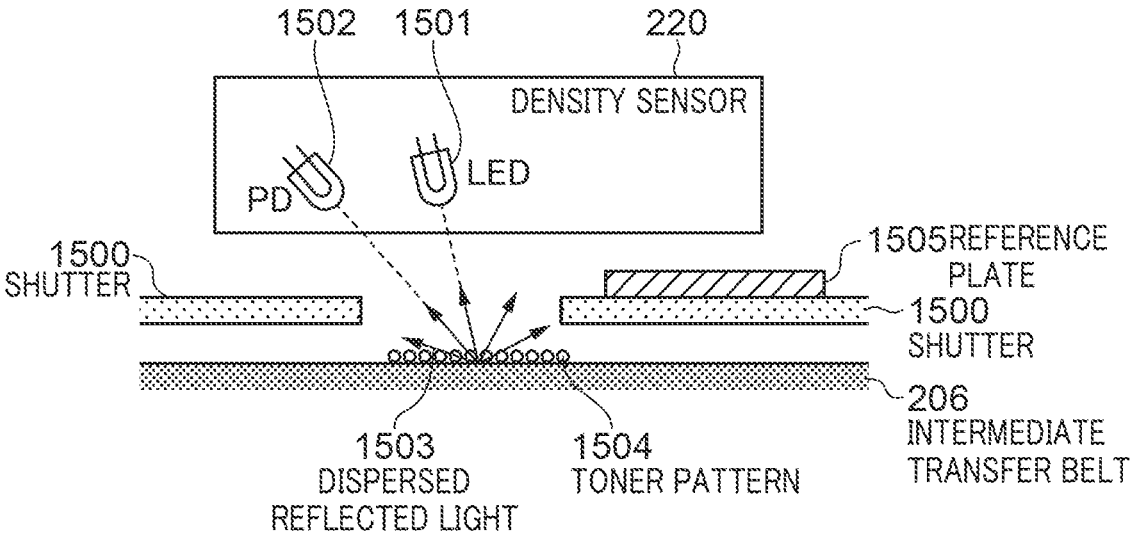
FIGS. 15A and 15B are views useful in explaining how a toner pattern is detected by a density sensor in FIG. 2.
Figure 15B:
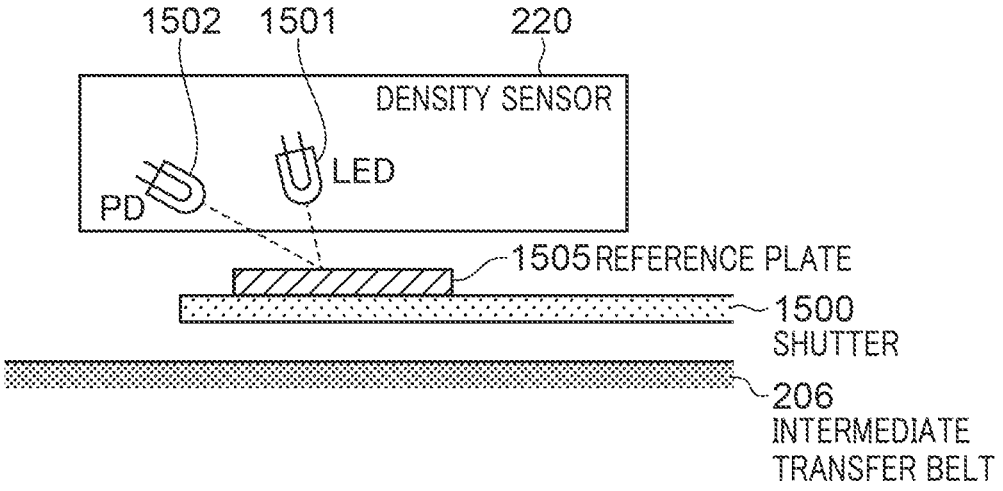

FIGS. 15A and 15B are views useful in explaining how a toner pattern is detected by the density sensor 101 in FIG. 2. The density sensor 220 is disposed so as to face the intermediate transfer belt 206 as shown in FIG. 15A and detects a toner pattern 1504 formed on the intermediate transfer belt 206. The density sensor 220 is comprised of the LED 1501 that emits infrared radiation, the PD 1502 that receives infrared radiation, and an electric substrate (not shown) on which the LED 1501 and the PD 1502 are mounted. It should be noted that a light receiving unit of the density sensor 220 is not limited to the PD, but may be a photo transistor.

The LED 1501 is disposed so as to irradiate the intermediate transfer belt 206 with infrared radiation at an incidence angle of 20°. The PD 1502 is disposed so as to receive diffused reflected light 1503 of the light, which has been emitted to the intermediate transfer belt 206 and the toner pattern 1504, at a reflection angle of −50°. These optical elements are mounted on the electric substrate (not shown) comprised of a drive circuit (not shown) that supplies electric current to the LED 1501 and a light receiving circuit (not shown) that has an conversion function of converting flowing current to voltage according to the amount of light received by the PD 1502. It should be noted that in the present embodiment, the density sensor 220 is not limited to the above arrangement but has only to be an optical density sensor. For example, the density sensor 220 may, instead of being configured to detect the diffused reflected light 1503 from the toner pattern 1504, be configured to detect light reflected from the intermediate transfer belt 206 and detect density using attenuation of light reflected from the intermediate transfer belt 206 according to the amount of toner attached to the intermediate transfer belt 206.

There may be cases where paper dust derived from the conveyed recording material S and toner to be attached to the intermediate transfer belt 206 are scattered in the image forming apparatus 101. If the scattered paper dust and toner become attached to the density sensor 220, the amount of light emitted from and the amount of light received by the density sensor 220 will decrease, resulting in the accuracy of toner density detection by the density sensor 220 being decreased. To prevent the decrease in the accuracy of toner density detection by the density sensor 220, the printer unit 200 has the shutter 1500 for keeping the density sensor 220 from becoming dirty. The shutter 1500 is disposed between the density sensor 220 and the intermediate transfer belt 206. The shutter 1500 moves in a direction parallel to the density sensor 220 and the intermediate transfer belt 206. The shutter 1500 is controlled to open and close by the shutter drive unit 1404. For example, in a case where the density is to be detected, the shutter drive unit 1404 opens the shutter 1500 such that an opening of the shutter 1500 is formed at such a position as not to block light emitted from the density sensor 220 and reflected light to be received by the density sensor 220 (see, for example, FIG. 15A). On the other hand, in a case where the density is not to be detected, the shutter drive unit 1404 closes the shutter 1500 so as to block passage between an optical unit (the LED 1501 and the PD 1502) of the density sensor 220 and the intermediate transfer belt 206 (see, for example, FIG. 15B).

As described above, in the present embodiment, the amount of dirt attached to the density sensor 220 can be considerably decreased by closing the shutter 1500 in the case where the density is not to be detected. However, in the case where the density is to be detected, the shutter 1500 is opened, and hence nothing blocks the passage between the optical unit of the density sensor 220 and the intermediate transfer belt 206, resulting in paper dust and toner becoming attached to the density sensor 220 through the opening. As the amount of toner attached to the density sensor 220 increases, the amount of light emitted from and the amount of light received by the density sensor 220 gradually decreases. When the amount of light emitted from and the amount of light received by the density sensor 220 decreases, a detected value of toner density of the toner pattern 1504 becomes smaller than actual. That is, the accuracy of toner density detection by the density sensor 220 degrades.

To prevent such degradation in the accuracy of toner density detection by the density sensor 220 caused by attachment of paper dust and toner, in the printer unit 200, light amount adjustment control is performed so as to increase the LED drive current and to keep the amount of light from the density sensor 220 constant. In the light amount adjustment control, the density sensor 220 irradiates a reference plate 1505, which maintains its constant reflectivity, with light, and detects reflected light. The reference plate 1505 is mounted on a surface of the shutter 1500 which faces the density sensor 220, as shown in FIG. 15B. The printer control unit 1400 controls the shutter drive unit 1404 to perform the light amount adjustment control while the reference plate 1505 being placed so as to face the optical unit of the density sensor 220. It should be noted that in the present embodiment, the light amount adjustment control should not be limited the mentioned-above method using reflected light from the reference plate 1505, and for example, may be performed using reflected light from the intermediate transfer belt 206.

Figure 16:
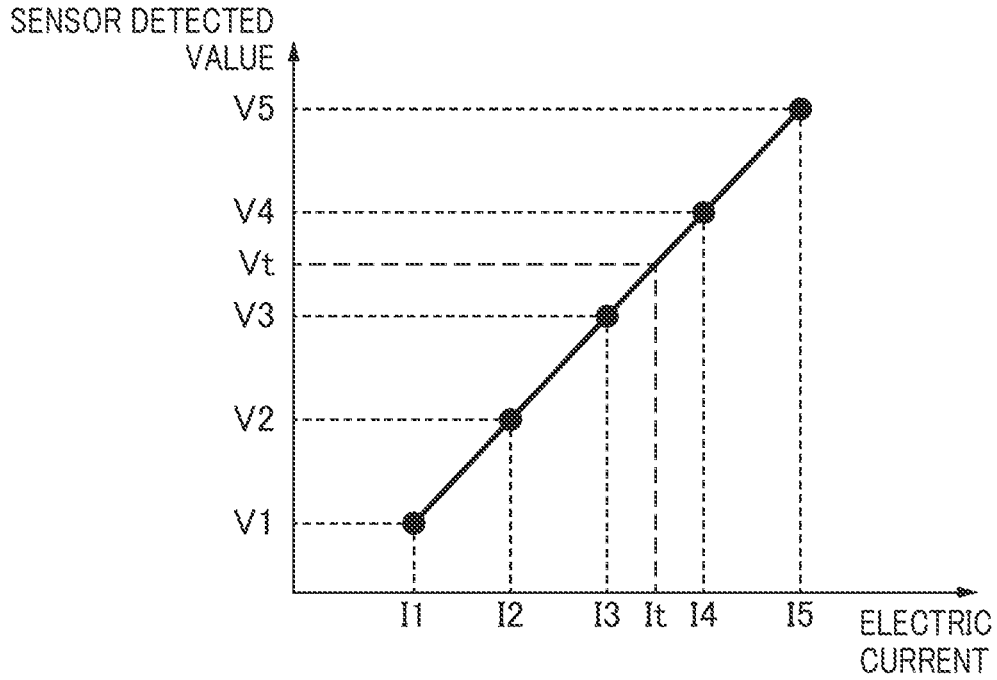
FIG. 16 is a graph showing the relationship between LED driving current of the density sensor in FIG. 2 and values detected by the density sensor in FIG. 2.

FIG. 16 is a graph showing the relationship between LED driving current for the density sensor in FIG. 2 and values detected by the density sensor 220 in FIG. 2. Referring to FIG. 16, the horizontal axis represents LED drive current values of the density sensor 220, and the vertical axis represents values detected by the density sensor 220. In the light amount adjustment control, the LED drive current values that are control values for controlling the amount of light from the LED 1501 are switched in five levels, and reflected light from the reference plate 1505 in each level of the LED drive current values is detected. In FIG. 16, I1 to I5 designate the LED drive current values in the five levels, and V1 to V5 designate values detected by the density sensor 220 when the LED drive currents I1 to I5 are supplied to the LED 1501. Vt designates a value detected by the density sensor 220 and set as a target when the amount of light from the LED 1501 is adjusted. Namely, Vt is the value detected when the density sensor 220 has detected reflected light from the reference plate 1505 when an arbitrary LED drive current is supplied during initial installation of the image forming apparatus 101. At the time of the initial installation, dirt derived from scattering of paper dust or toner is not attached to the density sensor 220, and namely, Vt is the value detected when the amount of dirt is the least.

The printer control unit 1400 compares the measured V1 to V5 and Vt with each other and extracts two points sandwiching Vt, namely, the largest value among values smaller than Vt and the smallest value among values larger than Vt. Referring to FIGS. 16, V3 and V4 are extracted. The printer control unit 1400 linearly interpolates between the extracted V3 and V4 to calculate an LED drive current value It corresponding to Vt. The printer control unit 1400 sets the calculated LED drive current value It as an adjusted LED drive current value. Specifically, the printer control unit 1400 updates an LED drive current value for density correction stored in the RAM 1408, to the calculated LED drive current value It. Thus, by setting the LED drive current value for density correction, to the calculated LED drive current value It, values detected by the density sensor 220 can be prevented from becoming smaller, and hence degradation in the accuracy of toner density detection by the density sensor 220 can be prevented. It should be noted that when the value of Vt is smaller than V1, or when the value of Vt is larger than V5, it is likely that the density sensor 220 could not normally detected density. For this reason, the LED drive current value for density correction, stored in the RAM 1408, is not updated to the LED drive current value It calculated based on Vt.

Figure 17:
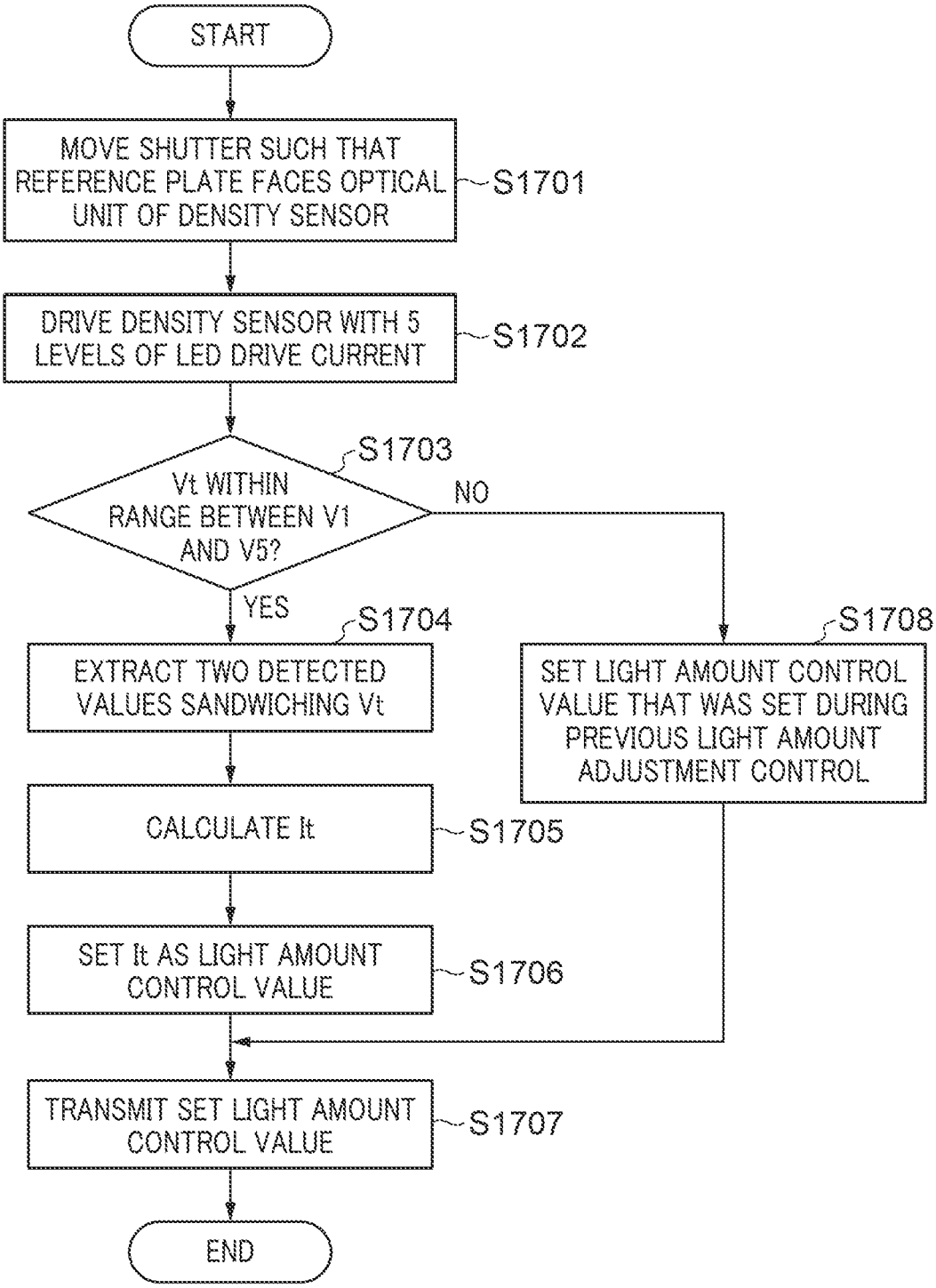
FIG. 17 is a flowchart showing the procedure of a light amount adjustment control process that is performed by the printer control unit in FIG. 14.

FIG. 17 is a flowchart showing the procedure of a light amount adjustment control process that is performed by the printer control unit 1400 in FIG. 14. The process in FIG. 17 is implemented by the CPU 1401 of the printer control unit 1400 executing a program stored in the ROM 1407 or the like. The process in FIG. 17 is carried out when a predetermined condition on which the characteristics of the density sensor 220 change is satisfied, for example, when execution of a job using the printer unit 200 is completed, when the image forming apparatus 101 is started, and when the image forming apparatus 101 returns from a power saving mode.

Referring to FIG. 17, first, the CPU 1401 moves the shutter 1500 to such that the reference plate 1505 faces the optical unit of the density sensor 220 (step S1701). Specifically, the CPU 1401 controls the shutter drive circuit 1403 to transmit a drive signal, which is an instruction to move the shutter 1500, to the shutter drive unit 1404. In accordance with the received drive signal, the shutter drive unit 1404 moves the shutter 1500 such that the reference plate 1505 faces the optical unit of the density sensor 220. Next, the CPU 1401 controls the density sensor drive circuit 1402 to transmit a drive signal to the density sensor 220 and drive the density sensor 220 with the LED drive currents in the five levels (I1 to I5) described above (step S1702). The CPU 1401 obtains the detected values V1 to V5, which were obtained when the LED drive currents in the five levels (I1 to I5) were supplied, from the density sensor 220. Then, the CPU 1401 determines whether or not Vt lies within a range between V1 and V5 (step S1703).

As a result of the determination in the step S1703, when Vt lies within the range between V1 and V5, that is, when V1 is equal to or greater than V1 and equal to or smaller than V5, the CPU 1401 extracts two detected values sandwiching Vt from V1 to V5 (step S1704). In the step S1704, the CPU 1401 extracts the largest detected value (for example, V3 in FIG. 16) from detected values smaller than Vt among V1 to V5 and extracts the smallest detected value (for example, V4 in FIG. 16) from detected values larger than Vt among V1 to V5. Next, the CPU 1401 linearly interpolates between the extracted two detected values to calculate the LED drive current value It corresponding to Vt (step S1705). The calculated LED drive current value It is an LED drive current value for use in density adjustment from the next time. The LED drive current value for use in density adjustment will hereafter be referred to as "the light amount control value for density adjustment". Then, the CPU 1401 sets the calculated LED drive current value It as the light amount control value for density adjustment from the next time (step S1706) and stores the set light amount control value in the RAM 1408. The RAM 1408 stores a plurality of light amount control values which have been set in the past as well as the light amount control value set in the step S1706. After that, the CPU 1401 transmits the light amount control value set in the step S1706 to the control unit 301 (step S1707) and ends the light amount adjustment control process.

As a result of the determination in the step S1703, when Vt does not lie within the range between V1 and V5, that is, when V1 is smaller than V1 or larger than V5, the CPU 1401 determines that the density sensor 220 could not normally detect density. The CPU 1401 sets the light amount control value set in the previous light amount adjustment control process as the light amount control value for density adjustment from the next time (step S1708) and stores the set light amount control value in the RAM 1408. After that, the CPU 1401 ends the light amount adjustment control process.

Figure 18:
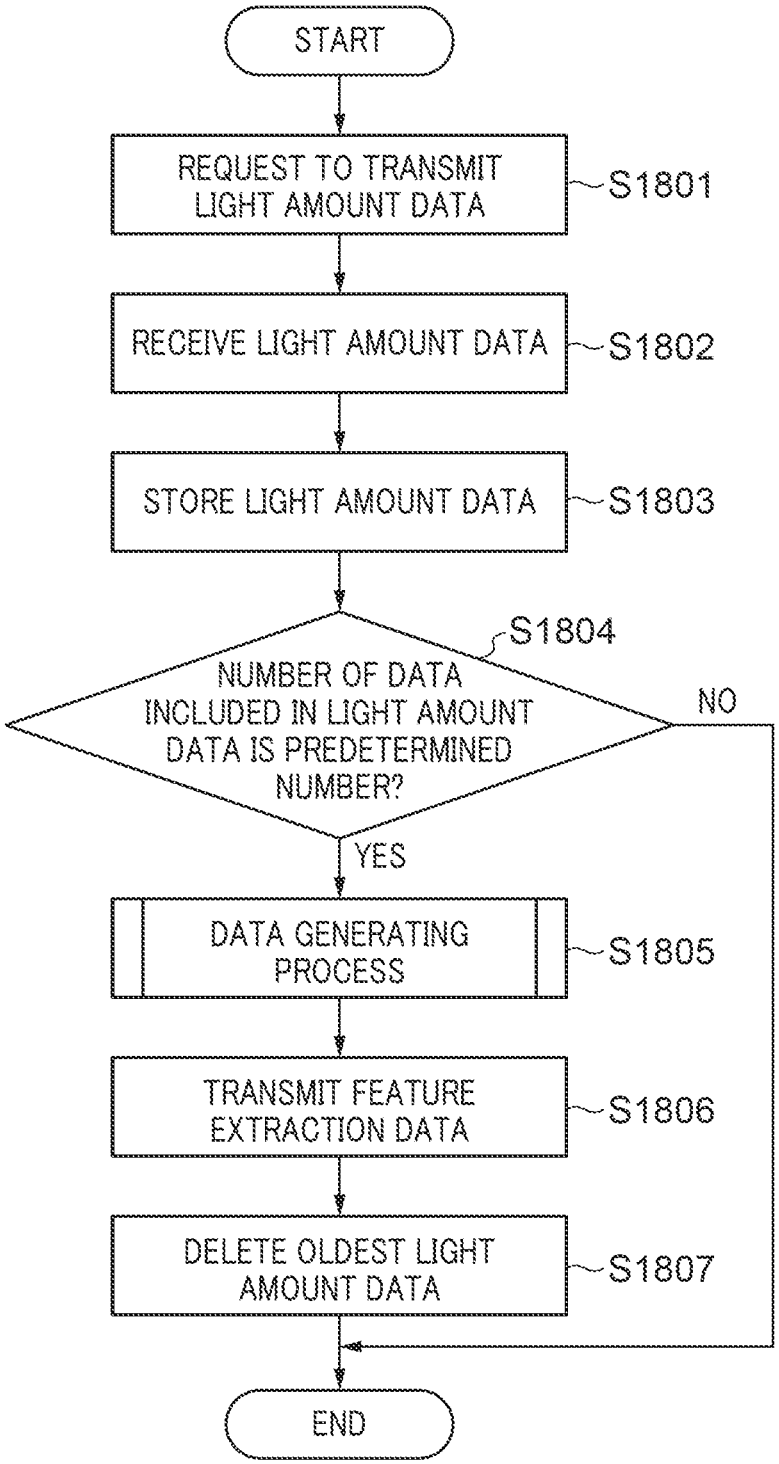
FIG. 18 is a flowchart showing the procedure of a feature extraction data transmission process that is carried out by the image forming apparatus in FIG. 1.

FIG. 18 is a flowchart showing the procedure of a feature extraction data transmission process that is carried out by the image forming apparatus 101 in FIG. 1. The process in FIG. 18 is implemented by the CPU 302 of the control unit 301 executing the program 308. The process in FIG. 18 is regularly carried out, for example, at predetermined time intervals set in advance or at predetermined times set in advance.

Referring to FIG. 18, the CPU 302 requests the printer control unit 1400 to transmit light amount data (step S1801). The light amount data includes a plurality of data such as a light amount control value set the last time and a light amount control values set prior to the last time. Next, the CPU 302 receives the light amount data from the printer control unit 1400 (step S1802) and stores the received light amount data in the memory 303 (step S1803). The memory 303 stores a plurality of light amount data received from the printer control unit 1400 in the past as well as the light amount data received in the step S1802. Then, the CPU 302 determines whether or not the number of data included in the light amount data received in the step S1802 is a predetermined number set in advance (for example, 30) (step S1804).

As a result of the determination in the step S1804, when the number of data included in the received light amount data is the predetermined number (for example, 30), the CPU 302 carries out a data generating process in FIG. 19 (step S1805), which will be described later, to generate the feature extraction data 311. Then, the CPU 302 transmits the generated feature extraction data 311 to the server 103 (step S1806). It should be noted that in a case where the management apparatus 104 is configured to be capable of accumulating a plurality of feature extraction data 311 including past data, the CPU 302 may be configured to directly transmit the feature extraction data 311 to the management apparatus 104 as described above.

Then, the CPU 302 deletes the oldest light amount data among the plurality of light amount data stored in the memory 303 (step S1807). After that, the CPU 302 ends the feature extraction data transmission process.

As a result of the determination in the step S1804, when the number of data included in the received light amount data is not the predetermined number (for example, 30), the CPU 302 ends the feature extraction data transmission process without generating or transmitting the feature extraction data 311.

It should be noted that in the above-described process in FIG. 18, the CPU 302 may determine, in the step S1804, whether or not the number of data included in the light amount data received in the step S1802 is equal to or greater than a predetermined number set in advance (for example, 30). When the number of data included in the light amount data received in the step S1802 is equal to or greater than the predetermined number (for example, 30), the feature extraction data transmission process proceeds to the step S1805. When the number of data included in the light amount data received in the step S1802 is smaller than the predetermined number (for example, 30), the feature extraction data transmission process is ended.

Figure 19:
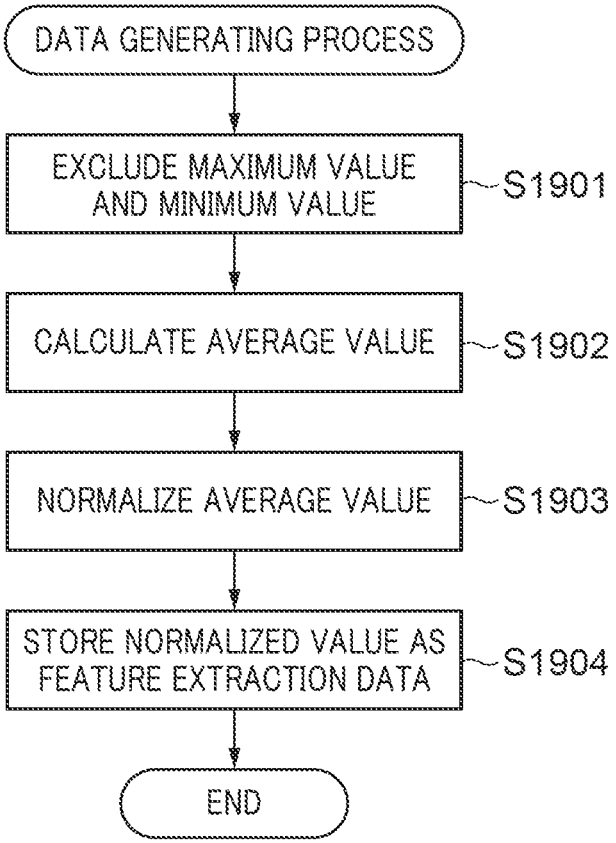
FIG. 19 is a flowchart showing the procedure of a data generating process in step S1805 in FIG. 18.

FIG. 19 is a flowchart showing the procedure of the data generating process in the step S1805 in FIG. 18.

Referring to FIG. 19, the CPU 302 excludes a maximum value and a minimum value from data included in the light amount data received in the step S1802 (step S1901). Next, the CPU 302 calculates an average value of data that was not excluded in the step S1901 among the data included in the light amount data received in the step S1802 (step S1902). By carrying out the processes in the steps S1901 and S1902, variations in feature values of the feature extraction data 311 can be reduced. It can be considered that variations in the light amount control values are caused by, for example, changes in the amount of light emitted from the LED 1501 of the density sensor 220 arising from changes in the internal temperature of the image forming apparatus 101.

Then, the CPU 302 normalizes the calculated average value (step S1903). Specifically, the CPU 302 divides the calculated average value by an upper limit value of a control range for the LED drive currents. The upper limit value of the control range is a value determined based on device characteristics of the LED 1501. Here, a value obtained by the normalization in the step S1903 is "1" when the average value calculated in the step S1902 is equal to the upper limit value of the control range for the LED drive currents. Namely, when the value obtained by the normalization in the step S1903 is "1", the light amount adjustment control is not performed, and hence degradation in the accuracy of toner density detection by the density sensor 220 cannot be prevented. To prevent this situation, the abnormality prediction system 100 uses the value obtained by the normalization in the step S1903 for calculating the maintenance time for the image forming apparatus 101. It should be noted that a margin which the value obtained by the normalization in the step S1903 has relative to "1" is a margin relative to the time when maintenance is required.

Then, the CPU 302 stores the value obtained by the normalization in the step S1903 as the feature extraction data 311 in the memory 303 (step S1904). The feature extraction data 311 is data that indicates the feature of the light amount data on the density sensor 220 for calculating the maintenance time for the image forming apparatus 101 and is also data with a smaller data amount than that of the light amount data including a plurality of data. After that, the data generating process is ended.

Figure 20:
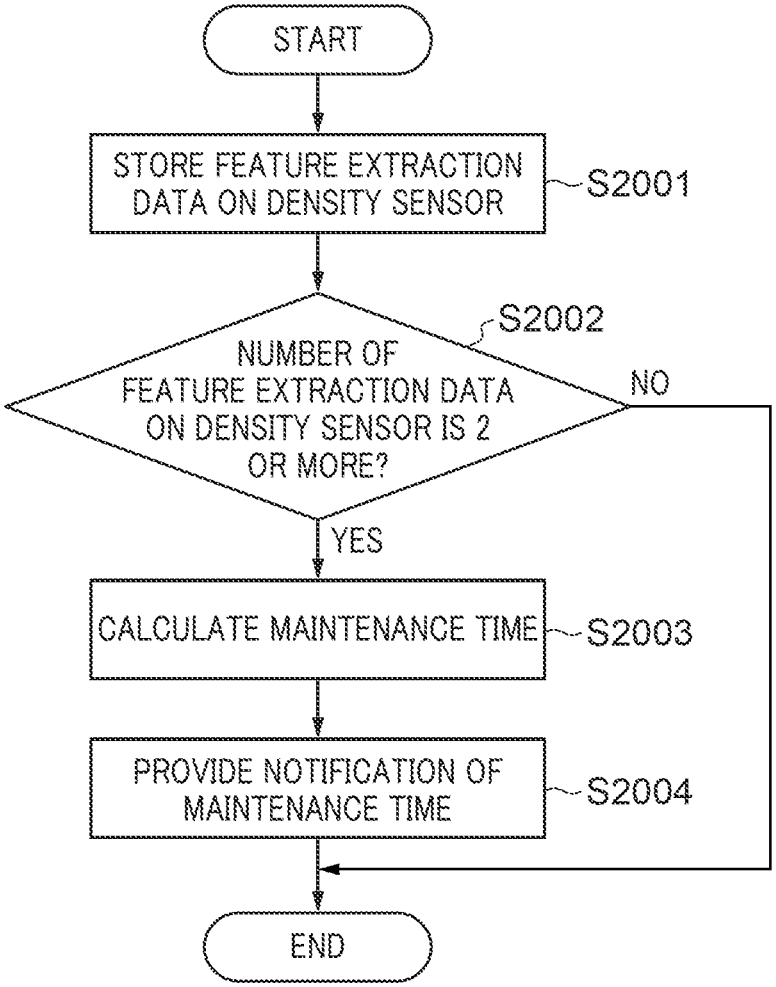
FIG. 20 is a flowchart showing the procedure of a maintenance time notification process that is carried out by the management apparatus in FIG. 1.

FIG. 20 is a flowchart showing the procedure of a maintenance time notification process that is carried out by the management apparatus 104 in FIG. 1. The maintenance time notification process in FIG. 20 is implemented by the CPU 401 of the management apparatus 104 executing a program stored in the memory 402 or the storage device 403. It should be noted that in the present embodiment, the management apparatus 104 carries out the maintenance time notification process at a timing set in advance, for example, at predetermined time intervals, predetermined times, and so forth. Further, the management apparatus 104 carries out the maintenance time notification process when receiving a request to carry out the maintenance time notification process from the image forming apparatus 101 or the like which is operated by the maintenance inspector 106 or the like.

Referring to FIG. 20, the CPU 401 receives the feature extraction data 311 on the density sensor 220 from the server 103 (or directly from the image forming apparatus 101 or the like) and stores the received feature extraction data 311 on the density sensor 220 in the storage device 403 (step S2001). Next, the CPU 401 determines whether or not the number of feature extraction data 311 on the density sensor 220 stored in the storage device 403 is two or more (step S2002). In the step S2002, for example, when the feature extraction data 311 on the density sensor 220 stored in the step S2001 and at least one piece of feature extraction data 311 on the density sensor 220 which was received prior to the feature extraction data 311 on the density sensor 220 stored at the step S2001 are stored in the storage device 403, the CPU 401 determines that the number of feature extraction data 311 on the density sensor 220 stored in the storage device 403 is two or more. On the other hand, when no feature extraction data 311 on the density sensor 220 other than the feature extraction data 311 on the density sensor 220 stored in the step S2001 is stored in the storage device 403, the CPU 401 determines that the number of feature extraction data 311 on the density sensor 220 stored in the storage device 403 is not two or more.

Figure 21:
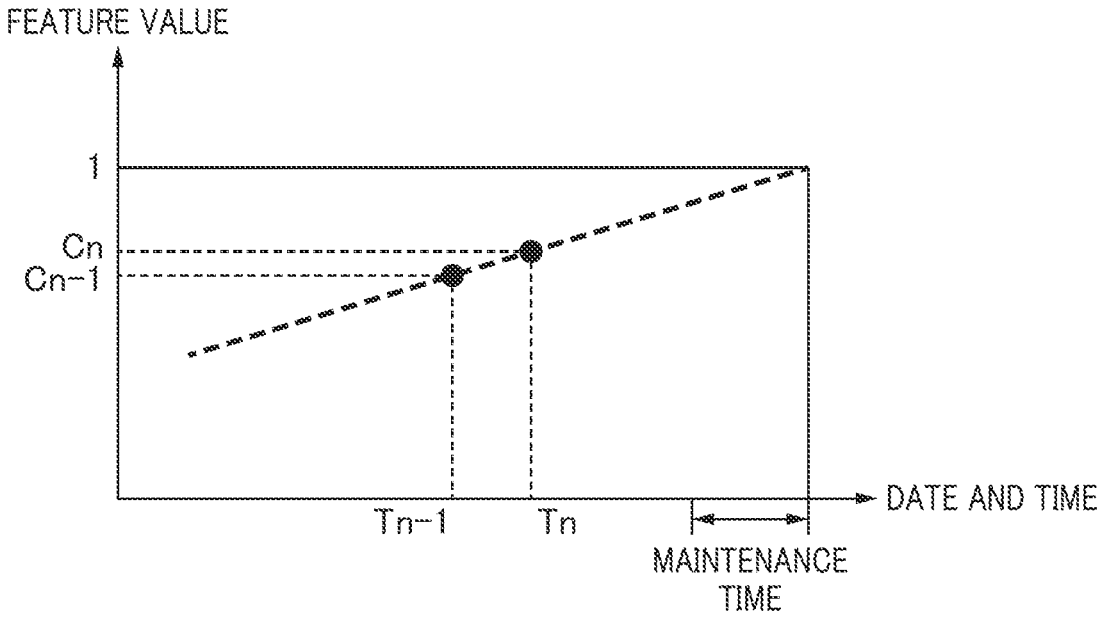
FIG. 21 is a view useful in explaining how a maintenance time is calculated in step S2003 in FIG. 20.

As a result of the determination in the step S2002, when the number of feature extraction data 311 on the density sensor 220 stored in the storage device 403 is two or more, the CPU 401 calculates the maintenance time for the image forming apparatus 101 based on the latest feature extraction data 311 on the density sensor 220 stored in the storage device 403 and at least one piece of feature extraction data 311 on the density sensor 220 received prior to the latest feature extraction data 311 (step S2003). For example, the CPU 401 calculates, in a way of extrapolation, a date and time at which the feature value becomes equal to "1" using the latest feature extraction data 311 on the density sensor 220 stored in the storage device 403 (for example, a feature value Cn in FIG. 21), the second latest feature extraction data 311 on the density sensor 220 stored in the storage device 403 (for example, a feature value Cn-1 in FIG. 21), and dates and times at which the respective pieces of feature extraction data 311 are generated (for example, Tn, Tn-1 in FIG. 21). The date and time at which the feature value becomes equal to "1" means a date and time at which it becomes impossible to perform the light amount adjustment control and to prevent degradation in the accuracy of toner density detection by the density sensor 220. It is necessary to perform maintenance of the density sensor 220 by this date and time. The CPU 401 sets the calculated date and time as a time limit for maintenance to be performed and calculates a time period between the time limit for maintenance to be performed and one month before that as the maintenance time for the image forming apparatus 101 with consideration that the maintenance inspector 106 make a maintenance plan.

Then, the CPU 401 notifies the maintenance inspector 106 of the calculated maintenance time (step S2004) and ends the maintenance time notification process.

As a result of the determination in the step S2002, when the number of feature extraction data 311 the density sensor 220 stored in the storage device 403 is not two or more, the CPU 401 ends the maintenance time notification process without providing notification of the maintenance time.

According to the embodiment described above, the management apparatus 104 obtains the latest feature extraction data 311 on the density sensor 220 generated by the image forming apparatus 101 and at least one piece of feature extraction data 311 on the density sensor 220 generated prior to the latest feature extraction data 311, and based on the obtained multiple feature extraction data 311 on the density sensor 220, predicts the maintenance time for the image forming apparatus 101. The feature extraction data 311 on the density sensor 220 is data that indicates features of the light amount data on the density sensor 220. Thus, the maintenance time for the image forming apparatus 101 can be predicted based on variations in the light amount data on the density sensor 220. Further, the feature extraction data 311 on the density sensor 220 has a smaller data amount than that of the light amount data including a plurality of data. For this reason, it is possible to keep down data traffic when the management apparatus 104 receives data from the server 103 or the like, and therefore, it is possible to keep down costs required to build and maintain the communication environment. Namely, in the present embodiment, it is possible to predict the maintenance time for the image forming apparatus 101 while keeping down costs required to build and maintain the communication environment.

In the embodiment described above, the feature extraction data 311 on the density sensor 220 is data obtained by dividing the average value, which is obtained by averaging at least a part of the plurality of light amount setting values included in the light amount data, by the upper limit value of the control range for the LED drive currents. The time when the density sensor 220 is needed to be performed maintenance on can be calculated using such data indicating characteristics of the density sensor 220 based on which it is possible to determine whether or not to perform the light amount adjustment control in the image forming apparatus 101. As a result, the maintenance time for the image forming apparatus 101 equipped with the density sensor 220 can be predicted.

Moreover, in the embodiment described above, extrapolation is used to predict the maintenance time for the density sensor 220 based on a plurality of accumulated feature extraction data 311 on the density sensor 220. As a result, the maintenance time for the image forming apparatus 101 can be predicted easily using the plurality of feature extraction data 311 on the density sensor 220 accumulated in the server 103 or the like.

Furthermore, in the embodiment described above, the density sensor 220 is a sensor that detects the densities of toner patterns formed on the intermediate transfer belt 206. Therefore, maintenance of the image forming apparatus 101 can be performed before occurrence of a failure such as the density sensor 220 becomes unable to detect the densities of toner patterns formed on the intermediate transfer belt 206.

In the embodiment described above, since the feature extraction data 311 is accumulated in the server 103, the accumulated feature extraction data 311 (hereafter referred to as "the accumulated data") can be utilized to develop new technology. A description will now be given of an example in which the accumulated data is utilized to add a function of identifying failed parts.

In a case where a factor that causes a change in the characteristics of the density sensor 220 is dirt attached to the density sensor 220 as described above, the characteristics of the density sensor 220 have a tendency of slowly changing over a certain period of time. On the other hand, in a case where a factor that causes a change in the characteristics of the density sensor 220 is a failure of the density sensor 220, the characteristics of the density sensor 220 have a tendency of sharply changing at the timing when the density sensor 220 has failed. For example, when the shutter drive unit 1404 of the density sensor 220 has failed, it becomes impossible to move the shutter 1500 to an appropriate position where the reference plate 1505 faces the optical unit of the density sensor 220 at the timing when the shutter drive unit 1404 is failed. Namely, in the light amount adjustment control, the density sensor 220 becomes unable to detect reflected light from the reference plate 1505 as intended. As a result, a light amount control value that greatly differs from a light amount control value set the last time is set in the light amount adjustment control. Namely, the characteristics of the density sensor 220 sharply change. In the present embodiment, details of required maintenance are predicted based on such tendencies of changes in the characteristics of the density sensor 220. For example, when the characteristics of the density sensor 220 change relatively slowly, it is predicted that maintenance involving removal of dirt from the density sensor 220 will be required. On the other hand, when the characteristics of the density sensor 220 sharply change, it is predicted that maintenance involving repair of the shutter drive unit 1404 will be required.

Moreover, by comparing the accumulated data in the server 103 and the failure logs for the image forming apparatus 101 with each other, it is possible to find out tendency of change in data when a failure occurs. The function of identifying failed parts based on the accumulated data can be developed and implemented, by finding out the tendency of data at the timing when a failure occurs. With this function, the maintenance inspector 106 can be notified of a failed part in advance and head for a maintenance with preparing a replacement part, to smoothly perform maintenance.

Although in the embodiment described above, the maintenance time for the image forming apparatus 101 is predicted based on the plurality of feature extraction data 311 on the density sensor 220 generated at different times, the type of the feature extraction data 311 is not limited to the feature extraction data 311 on the density sensor 220. The feature extraction data 311 may be any type as long as changes in the characteristics can be determined by comparing a plurality of feature extraction data 311 of the same type generated at different times.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-130873, filed on Jul. 31, 2020 and Japanese Patent Application No. 2020-132484, filed on Aug. 4, 2020, which are hereby incorporated by reference herein in their entirety.

What is claimed is:

1. A control method for controlling an image forming apparatus with a sensor, the control method comprising:

generating, based on first data comprising measured values obtained by the sensor, second data for use in detecting a sign of abnormality in the image forming apparatus; and transmitting the second data directly or indirectly to a management apparatus that detects the sign of abnormality, wherein the second data is data that indicates characteristics of the image forming apparatus and has a smaller data amount than that of the first data.

2. An image forming apparatus with a sensor, comprising:

at least one memory that stores a set of instructions; and at least one processor that executes the instructions, the instructions, when being executed, causing the image forming apparatus to:

generate, based on first data comprising measured values obtained by the sensor, second data for use in detecting a sign of abnormality in the image forming apparatus; and transmit the second data directly or indirectly to a management apparatus that detects the sign of abnormality, wherein the second data is data that indicates characteristics of the image forming apparatus and has a smaller data amount than that of the first data.

3. The image forming apparatus according to claim 2, wherein a time to transmit the second data is set in advance, and in a case where it is the time to transmit the second data and the generated second data is the same data as the second data transmitted the last time, the at least one processor does not transmit the generated second data directly or indirectly to the management apparatus.

4. The image forming apparatus according to claim 2, wherein the second data is data obtained by creating a histogram from the first data.

5. The image forming apparatus according to claim 2, wherein the second data is data obtained by performing spectrum formation on the first data.

6. The image forming apparatus according to claim 2, wherein the sensor detects a toner image transferred onto a transfer body which the image forming apparatus has, wherein the management apparatus obtains the latest second data generated based on the first data, and at least one piece of second data generated prior to generation of the latest second data, and predicts maintenance time for the image forming apparatus based on the obtained multiple second data, and wherein the second data is data that indicates features of the first data and has a smaller data amount than that of the first data.

7. The image forming apparatus according to claim 6, wherein the first data includes a plurality of control values for controlling an amount of light from light emitting device which the sensor has, and the second data is data that is obtained by dividing a value, which is obtained by averaging at least a part of the plurality of control values, by an upper limit value of a control range for the control values.

8. The image forming apparatus according to claim 6, wherein the management apparatus predicts, in a way of the extrapolation, the maintenance time for the image forming apparatus based on the obtained multiple second data.

9. The image forming apparatus according to claim 6, wherein the sensor is a density sensor configured to detect a density of a toner image transferred onto the transfer body.

10. A non-transitory storage medium storing a program for causing a computer to execute a control method for controlling an image forming apparatus with a sensor, the control method comprising:

generating, based on first data comprising measured values obtained by the sensor, second data for use in detecting a sign of abnormality in the image forming apparatus; and transmitting the second data directly or indirectly to a management apparatus that detects the sign of abnormality, wherein the second data is data that indicates characteristics of the image forming apparatus and has a smaller data amount than that of the first data.

11. A management system including an image forming apparatus with a sensor and a management apparatus, comprising:

at least one memory that stores a set of instructions; and at least one processor that executes the instructions, the instructions, when being executed, to perform:

in the image forming apparatus, generating second data based on first data comprising measured values obtained by the sensor, and transmitting the second data to the management apparatus; and in the management apparatus, detecting a sign of abnormality in the image forming apparatus based on the transmitted second data, wherein the second data is data that indicates characteristics of the image forming apparatus and has a smaller data amount than that of the first data.

* * * * *